US009464871B2

(12) United States Patent
Bay

(10) Patent No.: US 9,464,871 B2
(45) **Date of Patent: *Oct. 11, 2016**

(54) SYSTEM AND METHOD FOR BALLISTIC SOLUTIONS

(71) Applicant: Laurence Andrew Bay, Atlanta, GA (US)

(72) Inventor: Laurence Andrew Bay, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/679,000

(22) Filed: Apr. 5, 2015

(65) Prior Publication Data

US 2016/0245619 A1 Aug. 25, 2016

Related U.S. Application Data

(63) Continuation of application No. 14/082,171, filed on Nov. 17, 2013, now Pat. No. 9,004,358, and a continuation of application No. 13/602,284, filed on Sep. 3, 2012, now Pat. No. 8,608,069, and a (Continued)

(51) Int. Cl.

| | |
|---|---|
| ***G07F 19/00*** | (2006.01) |
| ***F41G 5/08*** | (2006.01) |
| ***F41G 11/00*** | (2006.01) |

(52) U.S. Cl.

CPC ..... *F41G 5/08* (2013.01); *F41G 11/00* (2013.01)

(58) Field of Classification Search

CPC ..... G06C 11/02; G06C 27/00; F41G 11/00; G01C 3/00

USPC ..... 235/23, 16, 19, 414; 356/152.1, 152.2, 356/153, 4.01, 5.01, 428; 250/342, 343; 42/122, 123, 130, 131; 33/297, 298; 256/428

See application file for complete search history.

(56) References Cited

U.S. PATENT DOCUMENTS 2,999,415 A 9/1961 Mandler et al. ..... 356/21
5,456,157 A 10/1995 Lougheed et al.

(Continued)

FOREIGN PATENT DOCUMENTS

EP 1748273 A1 1/2007
FR 2913266 A1 9/2008

(Continued)

OTHER PUBLICATIONS

European Patent App. No. 12805383, Sep. 5, 2014, EPO Search Opinion, 5 Sheets.

(Continued)

*Primary Examiner* — Karl D Frech

(74) *Attorney, Agent, or Firm* — Smith Tempel; Steven P. Wigmore

(57) ABSTRACT

Disclosed embodiments, as well as features and aspects thereof, are directed towards providing a system, device and method for calculating comprehensive ballistic solutions, or portions thereof, via a varying magnification optical range determining and ballistic trajectory calculating apparatus referred to as a ballistic solutions device. Advantageously, embodiments of a ballistic solutions device may drastically reduce marksman error in milling targets by employing a measurement component configured to measure angular movement of a projectile launching device, such as a rifle, thus delivering consistently accurate distance to target estimations. Additionally, embodiments of a ballistic solutions device may also comprise features and aspects that enable a user to leverage available real-time field data such that error associated with the measurement of those variables is minimized prior to calculating and rendering a comprehensive ballistic solution derived from stored DOPE.

20 Claims, 12 Drawing Sheets

Related U.S. Application Data continuation of application No. 12/879,277, filed on Sep. 10, 2010, now Pat. No. 8,281,995.

(60) Provisional application No. 61/241,763, filed on Sep. 11, 2009.

(56) References Cited

U.S. PATENT DOCUMENTS

| | | | | |
|---|---|---|---|---|
| 5,824,942 | A * | 10/1998 | Mladjan | F41G 1/48 42/105 |
| 6,357,158 | B1 | 3/2002 | Smith, III | |
| 6,499,382 | B1 | 12/2002 | Lougheed et al. | |
| 6,516,699 | B2 | 2/2003 | Sammut et al. | |
| 7,654,029 | B2 | 2/2010 | Peters et al. | |
| 7,877,886 | B1 | 2/2011 | Hamilton | 33/297 |
| 8,991,702 | B1 | 3/2015 | Sammut et al. | |
| 9,004,358 | B2 * | 4/2015 | Bay | F41G 3/06 235/414 |
| 9,091,507 | B2 | 7/2015 | Paterson et al. | |
| 2005/0198885 | A1 | 9/2005 | Staley | |
| 2006/0005447 | A1 | 1/2006 | Lenner | |
| 2007/0103673 | A1 | 5/2007 | Ash | |
| 2008/0094473 | A1 | 4/2008 | Rom | |
| 2009/0183417 | A1 | 7/2009 | Smith, III | |
| 2009/0199451 | A1 | 8/2009 | Zaderey et al. | |
| 2009/0199702 | A1 | 8/2009 | Zaderey et al. | |
| 2009/0205239 | A1 | 8/2009 | Smith, III | |
| 2010/0182426 | A1 | 7/2010 | Perruchot et al. | |
| 2011/0168777 | A1 | 7/2011 | Bay | |

FOREIGN PATENT DOCUMENTS

| | | | |
|---|---|---|---|
| FR | 2921149 | A1 | 3/2009 |
| GB | 2255398 | | 11/1992 |
| JP | 6141915 | A | 2/1986 |
| KR | 100963681 | B1 | 8/2010 |
| WO | 9623270 | A1 | 8/1996 |

OTHER PUBLICATIONS

European Patent App. No. 10851146, Nov. 28, 2014 EPO Search Opinion, 5Sheets.

ISR from PCT/US2012/031529, transmitted Jan. 30, 2013; two U.S. Refs, and two Foreign Refs, (cited in parent).

* cited by examiner

Generation of real-time ballistic solution range card

Generation of real-time ballistic solution MIL card

Optical Ranging via User-defined Reticule Ratio

SYSTEM AND METHOD FOR BALLISTIC SOLUTIONS

CROSS-REFERENCE TO RELATED APPLICATIONS

Priority under 35 U.S.C. §119(e) is claimed to U.S. provisional application entitled "VARYING MAGNIFICATION OPTICAL RANGE DETERMINING AND BALLISTIC TRAJECTORY CALCULATING APPARATUS," filed on Sep. 11, 2009 and assigned application Ser. No. 61/241,763. The entire contents of this application are hereby incorporated by reference. This application is also related to PCT Application Ser. No. PCT/US10/48385, filed on Sep. 10, 2010 in the name of Laurence Andrew Bay, entitled, SYSTEM AND METHOD FOR BALLISTIC SOLUTIONS.

BACKGROUND

Consistent short range shooting only requires a modest amount of skill and a weapon suitable for firing a reasonably flat and repeatable trajectory out to a couple hundred yards without regard for variations in ambient conditions. To consistently engage targets at long range, however, is a complex function of shooting skill, weapon system quality, reliable data query and, perhaps most importantly, applied math.

Even so, the first thing that a long-range marksman does with his weapon is the same thing that a novice marksman does—he calibrates or "zeroes" it. Typically, a rifle is fitted with a scope via a mounting system such that the scope is rigidly attached to the rifle and positioned in-line with the rifle's barrel. With the scope being rigidly fixed relative to the rifle, adjustments in the scope can be made by manipulating the position of lenses that form the scope.

Though usually not adjustable itself, the mounting system may comprise an inclined base in order to angle the scope's default line of sight (DLOS) slightly downward (default elevation and windage settings of a scope are usually set at the median points within the relative ranges of available adjustment), relative to the baseline represented by the axis of the rifle's barrel bore, so that the DLOS intersects a line projected from the rifle's barrel at a point some distance in front of the rifle. Notably, while an inclined mounting system is not an absolute in all rifle/scope combinations, a marksman would know that it offers potential advantages to a long range marksman including the effective increase of the practical elevation adjustment range of the scope for long distance shots. That is, because the inclined mounting system inherently biases the rifle barrel up relative to the scope's line of sight, the trajectory of the bullet will start off at an upward angle thus necessitating less adjustment for longer shots. Initially, the point of intersection between the DLOS and the barrel axis projection is unknown and of little value to the marksman until the scope is "zeroed" to the rifle such that the point of intersection correlates with a point of bullet impact at a given distance.

When a rifle is zeroed with its scope, the point of a bullet's impact on a target at a given distance will coincide with the DLOS when the bullet is shot at certain ambient conditions and not affected by significant wind or marksman error, i.e. the bullet will hit the target "right on the crosshairs." Although there is no set standard for selecting a zero distance, zeroing a rifle/scope combination is most often done at a short range, typically 100 yards or less. The reason for short range zeroing is that the trajectory of the bullet is still relatively flat at a short range because the muzzle velocity (the velocity of the bullet at its maximum, i.e. shortly after it exits the barrel) has not degraded to such an extent that gravity has a significant effect on the bullet's flight path. As such, especially with a bullet caliber having a high ballistic coefficient and fast muzzle velocity, variations in ambient conditions, including moderate crosswinds, will not cause enough deviation in the predictable baseline trajectory of the bullet to warrant compensation by a marksman seeking to engage a target at or near the "zero" distance.

For the novice marksman, a properly zeroed rifle means locking down the scope settings and not worrying about the bullet's ballistics whether the shot to be taken is at 25 yards or 150 yards—he knows that the change in trajectory due to the deviation in range off his zero distance is well within the available margin of error for hitting a short range target. For a long range marksman, however, a zero distance serves only as a good, predictable starting point—he's not looking to engage targets at 150 yards but, rather, at significantly longer distances, such as on the order of 1500 yards or more.

The suitability of a given rifle caliber for long range shooting directly correlates with the caliber's ballistic coefficient and muzzle velocity. The higher the ballistic coefficient, the better the particular caliber bullet slices through the atmosphere. The faster the muzzle velocity, the farther the bullet flies before aerodynamic forces reduce the bullet's stability. Therefore, a high ballistic coefficient coupled with a high muzzle velocity is a desirable combination for long range target engagement. However, even calibers with desirable ballistic coefficients and fast muzzle velocities capable of keeping the bullet at supersonic speeds for long distances can drop upwards of 4 feet below DLOS at just 500 yards. At 600 yards, the same exemplary bullet can drop below DLOS an additional 2½ feet. Change the ambient conditions, such as humidity, barometric pressure, temperature and crosswind strength, and that 500 yard shot using the zeroed crosshairs may be 1½ feet to the left of a target and below the DLOS as if it were shot at 600 yards instead of 500.

Clearly, for a long range marksman, the zero distance is just a jumping off point for making adjustments. If long range targets are going to be hit precisely, then factors and conditions such as target distance, crosswind strength, humidity, barometric pressure, coriolis effect, and temperature, among others, must be considered and compensated for. As such, once the rifle has been zeroed at a given distance and ambient conditions, a long range marksman will begin to collect data at varying distances and conditions in order to develop what is known to one of ordinary skill in the art as a Data Observed from Prior Engagements or "DOPE" book.

A DOPE book can be used by the long range marksman to make adjustments in the field based on the actual field conditions for the shot versus the controlled "zero" conditions. More particularly, by referring to the empirical data documented in his DOPE book, a marksman can predict how far off point of impact his DLOS will be and, accordingly, make adjustments to correct the predicted error. However, practicality dictates that a DOPE book can only document so much data and, therefore, it is inevitable that the marksman will often use the DOPE data as a general guide to get him "most of the way home" before applying his judgment and experience to estimate the actual adjustments required to make the shot.

As an example, a given DOPE book may record data for target distances ranging from 500 to 1500 yards in 20 yard increments with a 10 mph crosswind, based on a specific rifle that has been zeroed at 100 yards using a specific round. While the exemplary DOPE book would be useful for the long range marksman seeking to make a shot in the 1000 yard range, it may not be "dead on" as the actual distance to target may have been estimated at 1015 yards with an 8 mph crosswind. To further complicate the calculation, consider that the gun was zeroed at 90% relative humidity and 90 degrees Fahrenheit at sea level, as opposed to the exemplary field conditions being measured at 40% humidity and 30 degrees Fahrenheit on top of a mountain, and one can easily see how drastically different the settings must be from the zero in order to score a hit. The point is that if the marksman doesn't have his "DOPE" book exactly on point, which he rarely does, he must either extrapolate or interpolate the required adjustments.

In addition to the inevitable estimation from DOPE records, the more estimation required on the part of the marksman concerning field conditions, the more likely that the adjustments calculated from those estimations will be inaccurate. Of all the estimations, perhaps the pivotal estimation for a long range marksman is the initial distance to target. Considering that at a 1000 yard distance even a caliber with desirable long range ballistics may be dropping up to one inch for every yard of forward travel, the result of a misjudged distance to target is a significant and costly miss. Underestimate the distance to target by a mere 10 yards and the shot could be almost a foot low.

There are basically two methods used in the art to estimate the all important distance to target. The first method is to "mil" the target and the second method is to use an infrared/laser (IR/Laser) range finding device. IR/Laser ranging devices are very accurate, using the known speed of light bouncing off the target to calculate the distance to target. However, in many applications, such as military sniping, use of an IR/Laser device can be seen by an enemy, thus compromising a sniper's position. For this reason, many long range marksmen rely on the "mil" method.

The process of "milling" a target to determine its distance comprises translating the target's linear height, as seen through an optical viewing device in units of mils, into corresponding units of angular measure which are useful for adjusting a line of sight (e.g., raising the point of aim by pivoting a weapon up). Consequently, if an object's height is known (or accurately estimated), then the number of mils required to demarcate the object's height as seen through an optical viewing device can be used to calculate the distance to the object. With the distance to object calculated and mapped to a known ballistic trajectory curve, adjustments for aim can be given in units of angular measure.

Notably, it will be understood by one of ordinary skill in the art that the use of the term "mil" as a verb, at least as it pertains to estimating target height, distance, crosswind, etc. is a comprehensive term for methods that employ linear and angular units of measure including, but not limited to, mils, minutes of angle, radians, inches per hundred yards and user-defined units. Thus, "milling" is a term in the art and its use is not intended to be limited to methods for calculating ballistic solutions that make use of mils as a unit of measure.

To actually "mil" an object and calculate its distance, an essential device for long range shooting is a scope or range finder that comprises a reticule, i.e. a network of fine lines or markings 15 that can be seen by the marksman when looking through the eyepiece of the scope (FIG. 1A). Range finder devices known in the art, or a scope with a reticule, provide a marksman with a means to determine the distance to target, assuming, of course, that the marksman can accurately estimate the target's height. If the height of the target is known (or accurately estimated), and the distance between the scope or range finder reticule markings can be correlated with an angle of measure, then a right triangle is defined with the target height as the length of the leg opposite the angle of measure. From the defined triangle, the distance to the target can be calculated via the tangent of the determined angle.

Once a target is "milled" based on its estimated or possibly known height, and a distance to target is calculated, a long range marksman can refer to his DOPE card or other ballistic data to determine just how far above the target he needs to aim in order for the bullet to impact the target. Of course, as noted previously, other factors must also be considered. It is well understood to one of ordinary skill in the art that ambient conditions such as barometric pressure, crosswinds, coriolis forces, temperature and humidity directly affect the trajectory of a bullet. Based on the empirical data of the DOPE book or other ballistic data available, the marksman can further amend the elevation calculation to compensate for those factors and arrive at a comprehensive ballistic solution for engaging the target. At such point, an application of the ballistic solution will dictate to the marksman that his particular weapon should be aimed at a certain "mil" height above the target and a certain "mil" distance off center of the target in order to score a hit (thus causing the marksman to adjust the angle at which the rifle is being aimed).

With a ballistic solution identified, the marksman has the option of either 1) leaving the scope at its zero and "holding off" the target as dictated by the ballistic solution or 2) accommodating the ballistic solution by adjusting the elevation and windage settings of his scope. For a marksman applying the first option, the reticule markings used to initially calculate distance can also be used to "hold off" the target according to the ballistic solution. For a marksman applying the second option, a reticule with a plurality of graduated markings within the rifle scope is not required as the mil or MOA angular adjustments will be made to the lenses within the scope, thus "moving" the crosshairs to correspond with the desired point of impact.

Infrared range finding technologies notwithstanding, the calculated distance to a target using trigonometry will only be useful if the marksman can 1) accurately estimate target height and 2) accurately estimate an angle of measure. Accuracy of target height estimation directly correlates with the marksman's ability to make the estimation. Likewise, even though the angle of measure can be determined based on scope or range finder reticule markings, the target may not fit exactly between reticule demarcations and, as such, the angle of measure estimation is also a function of marksman skill.

Therefore, to improve the accuracy of distance to target estimations for long range marksmen, there is a need in the art for devices and methods that can improve the estimation of inputs used to calculate target distance and/or target height. Further, there is a need in the art to improve the accuracy of ballistic solutions via devices and methods used to collect and manipulate data that affects bullet flight.

BRIEF SUMMARY

The presently disclosed embodiments, as well as features and aspects thereof, are directed towards providing a system, device and method for calculating comprehensive ballistic solutions, or portions thereof, via a varying magnification optical range determining and ballistic trajectory calculating apparatus (also referred to as a ballistic solutions device).

Advantageously, embodiments of a ballistic solutions device drastically reduce marksman error in milling targets by employing a measurement component configured to measure angular movement of a mechanically coupled optical viewing device, thus delivering consistently accurate distance to target estimations. Additionally, embodiments of a ballistic solutions device may also comprise features and aspects that enable a user to leverage available real-time field data such that error associated with the measurement of those data variables is minimized prior to calculating and rendering a comprehensive ballistic solution derived from stored Data Observed from Prior Engagements (DOPE).

One exemplary embodiment of a ballistic solution device comprises an inclinometer and is mechanically coupled to an optical viewing device useful for demarcating the height of an object. Because the exemplary ballistic solution device is mechanically coupled to the optical viewing device, articulation of the optical viewing device through an angular rotation can be measured by the comprised inclinometer. One skilled in the art will understand that such an embodiment is useful for the accurate calculation of a distance to target because error in "milling" the target can be drastically reduced versus known methods.

Consider the prior art method of a marksman estimating the number of mils in a reticule that are taken up by a target. With a ballistic solution device comprising an inclinometer and mechanically coupled to the marksman's weapon, the plurality of graduated reticule markings is not required for ranging the target. The marksman needs only to place a single reticule marking at the bottom of the target and then translate it to the top of the target—the inclinometer can measure the angular rotation of the marksman's rifle as the reticule marking is translated. The accuracy of the marksman's reticule marking translation from the bottom to the top (or the top to the bottom) of the target is drastically improved over the alternative method of a marksman estimating how many mils the target would take up in the reticule. With the angle known via the inclinometer, and the target height known or accurately estimated, the distance can be calculated via the tangent function of the measured angle.

Notably, it will be understood that a ballistic solutions device with a comprised inclinometer may also be used to accurately calculate the height of an object at a known distance. For example, if the distance to an object is known, the methodology described above could be used to "mil" the object, whereby the tangent function could be employed to solve for the object height.

As just described, an embodiment of a ballistic solutions device comprising an inclinometer can be used to accurately calculate a distance to target. Subsequently, the distance to target can be used in connection with a marksman's DOPE data in order to calculate a ballistic solution. One of ordinary skill in the art will understand that a marksman's DOPE data is often not comprehensive and, as such, the marksman must make judgments as to how actual field condition variables may affect the bullet's trajectory. Advantageously, some embodiments of a ballistic solutions device further comprise integrated DOPE data, means for manual input of field conditions or estimations, and/or sensors configured to collect real-time field condition data so that a comprehensive ballistic solution can be provided to the marksman.

For example, some embodiments of a ballistic solutions device, in addition to comprising an inclinometer, may be configured to receive user inputs of field conditions such as, but not limited to, crosswind strength. Additionally, some embodiments configured to provide a comprehensive ballistic solution may be configured to receive and reference standard DOPE data for given calibers or custom DOPE provided by the marksman. Also, some embodiments may comprise sensors configured to measure any number of field conditions including, but not limited to, altitude, barometric pressure, humidity, orientation relative to the equator, and temperature.

It will be understood that embodiments of a ballistics solutions device may comprise all, or just some, of the features and aspects outlined above and below. A particular embodiment configured to receive DOPE may leverage user inputs and/or sensor inputs, in conjunction with the calculated range derived from the inclinometer measurement, via algorithms known in the art of physics, in order to arrive at a comprehensive ballistic solution. That is, by incorporating the known and accurately estimated data, the DOPE may be algorithmically manipulated such that an accurate, real-time custom ballistic solution is delivered. Notably, while much of the ballistic algorithms that may be applied to DOPE data in order to calculate a ballistic solution based on field condition variables are known, the accuracy of the measurement of the field conditions directly correlates with the accuracy of the resulting ballistic solution. As such, one of ordinary skill in the art will recognize that embodiments of a ballistic solution device that comprise real-time sensors configured to measure field variables may deliver more accurate ballistic solutions than devices presently used in the art which require the user to estimate those field variables. Of course, it will also be understood that various embodiments of a ballistics solutions device may be configured such that the user can override or eliminate the consideration of a sensor input in favor of a manual input or none at all.

Outputs or deliverables generated by various embodiments of a ballistic solutions device include, but are not limited to, a MIL card, a range card, an updated DOPE card, scope setting adjustments, aiming or "holdover" recommendations, etc. With regards to the various outputs, a marksman may employ a ballistic solutions device to generate shot-specific data or entire data cards based on pre-input manual and measured variables.

As an example, a marksman may input known or estimated field conditions, such as crosswind strength, and, in conjunction with sensor inputs from sensors comprised within the exemplary ballistic solutions device, a comprehensive card may be generated for those specific conditions, wherein the card is generated from a stored baseline ballistic curve or baseline DOPE data that has been mathematically manipulated in light of the various inputs. The card may relay the adjusted data in terms of distance to target, MILS, MOA or the like. Advantageously, embodiments that are configured to output a card can provide a marksman with accurate adjustments to existing DOPE such that the marksman is not required to calculate those adjustments on a shot by shot basis. Moreover, other embodiments may generate a shot-specific output from pre-loaded manual and sensor inputs such that the marksman needs only to use the inclinometer functionality of the ballistic solutions device in order to trigger the generation of a real-time, shot-specific solution.

Regardless of the output of a given embodiment of a ballistic solutions device, one skilled in the art will understand that various exemplary embodiments of a ballistic solutions device may provide for different methods of solution implementation. For example, some embodiments may provide an output measured in MILS whereby the marksman is required to use a scope's reticule markings to "holdover" the target at a certain number of MILS. Other embodiments may require the marksman to actually adjust the scope's DLOS such that the new settings cause the crosshairs to correspond to the given target sought to be engaged.

Still other exemplary embodiments may cause the ballistic solution to be employed by automatic adjustment of the scope's erector assembly or lenses from the zero settings. As an alternative to adjusting a scope's erector assembly or lenses from the zero settings, other embodiments of a ballistic solutions device may cause a ballistic solution to be implemented via automatic adjustment of the base mechanism used to couple an optical viewing device to a rifle. Such embodiments that may be configured to adjust the scope mounting mechanism may comprise motors or manual gearing for manipulation of a scope's position relative to the centerline of the rifle's bore, thereby alleviating the need to change the scope's initial elevation and windage settings. More specifically, it is envisioned that embodiments configured to adjust a scope mounting mechanism may comprise positioning devices such as, but not limited to, servomechanisms which are known to one of ordinary skill in the art to be configured for precise and repeatable positioning of a communicated component. Similarly, some embodiments may comprise manually adjustable gearing mechanisms useful for accurate translation of a communicated component. Whichever adjustment mechanism is utilized, an embodiment configured to adjust a scope mounting or base mechanism will employ the adjustment mechanism to apply a ballistic solution via manipulation of the mechanism used to couple an optical viewing device to a rifle.

Moreover, various exemplary embodiments of a ballistic solutions device may be employed separately from the rifle or other projectile launching device that will be used to implement calculated ballistic solutions. Still other embodiments may be integrated into a rifle, a scope coupled to a rifle, or the mounting mechanism between a rifle and scope. Additionally, some embodiments may be configured to be used separately from a rifle and/or in direct communication with a rifle, as may be preferred by the user. It is also envisioned that some embodiments will comprise "quick disconnect" features or aspects that provide for the coupling and decoupling of the embodiment to a rifle or other device.

DETAILED DESCRIPTION

Figure 1A:
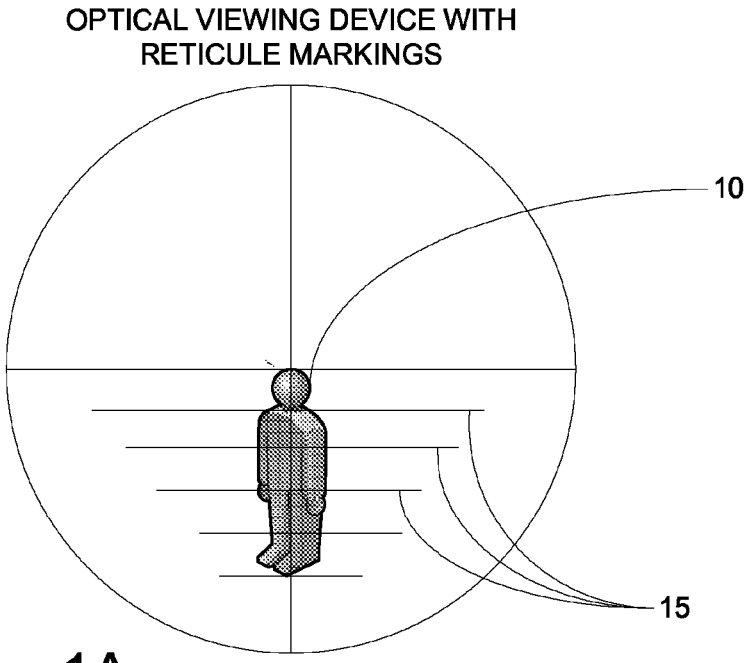
FIG. 1A depicts a scene of a target, such as a human target, that may be viewed through an exemplary rifle scope comprising a plurality of reticule markings.

The presently disclosed embodiments, as well as features and aspects thereof, are directed towards providing a system and method for calculating comprehensive ballistic solutions, or portions thereof, via a varying magnification optical range determining and ballistic trajectory calculating apparatus (generally referred to herein as a ballistic solutions device). Exemplary embodiments of a ballistic solutions device are disclosed herein in the context of long range rifle shooting, however, one of ordinary skill in the art will understand that various embodiments may also comprise any combination of features and aspects useful for other applications related to, but not limited to, range finding, bird watching, golfing, surveying, archery, etc. Moreover, as the described embodiments are disclosed in the context of long range shooting, one of ordinary skill in the art will understand that the reference to a "rifle" in this description is not intended to limit the use of a ballistic solutions device to be in conjunction with a rifle. Rather, the term rifle will be understood to anticipate any device, whether configured to launch a projectile or not, with which a ballistic solutions device may be used. That is, it will be understood that, in its simplest form, a ballistic solutions device is configured to operate in conjunction with any other device useful for making optical observations such as, but not limited to, a rifle, a rifle scope, binoculars, monoculars, an optical rangefinder, a user's arm or even a stick. As such, the description herein of embodiments specifically configured for shooting applications will not be interpreted to limit the scope of a ballistic solutions device.

Devices and methods presently known in the art of range finding and ballistic trajectory prediction rely heavily on user inputs and estimations in order to render suggested ballistic solutions. One of ordinary skill in the art understands that solutions rendered by any ballistic trajectory calculating device, or any applied mathematical formula, are only as useful as the inputs from which the solutions were calculated. As such, because the devices and methods known in the art require extensive user estimation, the solutions rendered by such devices are only as good as the estimation skills of the user.

As has been described, current methods for long range shooting require a marksman to rely heavily on his estimated input evaluated in context of weapon-specific Data Observed from Prior Engagements (DOPE) records (or field data of projectile drop based on range). A marksman's DOPE record is empirically derived by shooting a specific weapon, with a specific zero setting (e.g., the default scope settings calibrated such that, at certain ambient conditions, a specific bullet configuration fired from the weapon will impact a target point at a specified distance), at varying distances and ambient conditions. The resulting data, or DOPE, is valuable information in the field when a marksman seeks to determine a long range ballistic solution.

Granted, if all ambient conditions are held constant to the conditions under which a weapon was zeroed, a marksman would only need DOPE relative to a single ballistic curve because a bullet's trajectory in controlled conditions is predictable and repeatable. Under such utopian conditions, a marksman would need only to "raise" or "lower" the trajectory curve of the bullet, relative to the weapon's line of sight, in order to manipulate the distance at which the bullet would intersect the line of sight and impact the target. Of course, even under such utopian conditions, the marksman would have to know the distance to target. In long range field shooting applications, or tactical military engagements, however, there are more variables than those described under the utopian conditions. That is, in addition to random target distances, the field conditions are virtually guaranteed to differ from the DOPE conditions—thus making the calculation of a ballistic solution more complicated than simply manipulating the x-axis and y-axis of a single ballistic curve.

As has been described, before a long range marksman can reference his DOPE and determine a ballistic solution, the distance to target must be estimated. Methods known in the art require the marksman to "range" a target of a known or predictable size, whether such target is the actual target to be engaged or just a nearby object. To range a target, a marksman may employ a device with a reticule, such as the scope component of his weapon or a separate optical device specifically used for range finding. Importantly, however, it will be understood that any device useful for demarcating the height of an object such as, for example, a stick pointed at a distant object, may be suitable for use in conjunction with an embodiment of a ballistic solutions device and, as such, the present disclosure will not be construed such that a ballistic solutions device can only be used in connection with a rifle scope or range finding device known in the art of long range shooting. Again, as is known to one of ordinary skill in the art, reticule markings can be used to demarcate the height of a distant object. Based on the reticule demarcation, the distance to the target can be mathematically calculated with a degree of certainty commensurate with the accuracy of the demarcation.

In FIG. 1A, a scene of a target 10, such as a human target, that may be viewed through an exemplary rifle scope comprising reticule markings 15 is illustrated. At the particular magnification of the exemplary scope, the distance between two reticule marks represents one (1) mil, wherein 1 mil demarcates a yard of linear height at one thousand (1000) yards. Notably, therefore, in the example it should be understood that the same mil would demarcate more than a yard of linear height at a distance beyond one thousand yards and less than a yard of linear height at a distance shorter than one thousand yards. As such, suppose that it is known, or at least reasonably estimated, that the target 10 depicted in FIG. 1A is six feet tall, i.e. two yards in English units. Because the target 10 takes up five reticule markings 15, i.e. five mils, in the scope, it can be calculated that the target 10 is four hundred yards away.

Figure 1B:
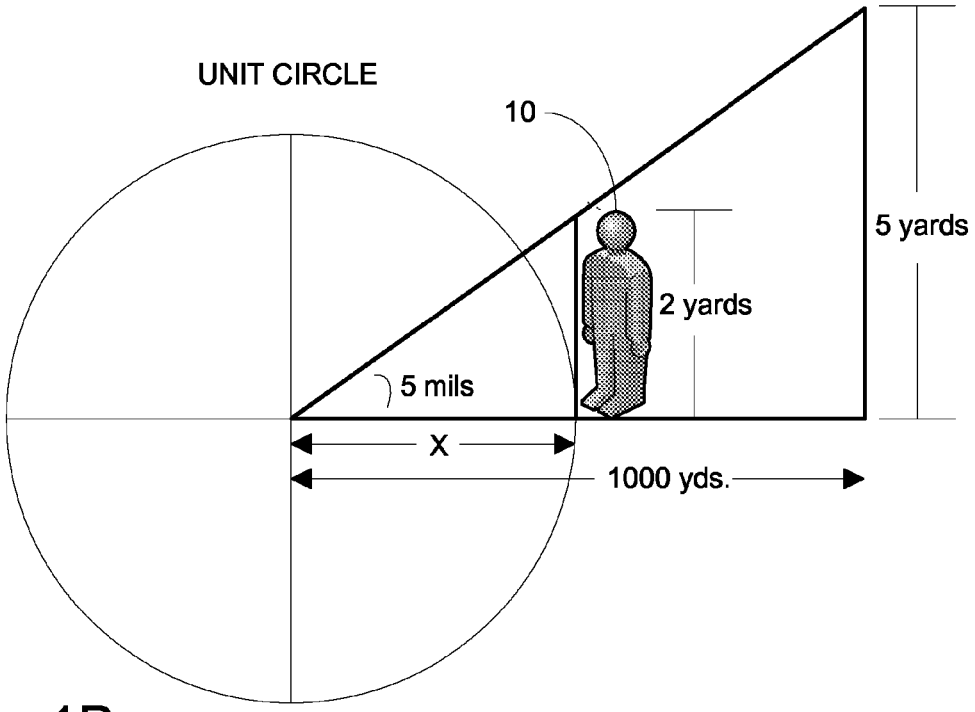
FIG. 1B is an exemplary unit circle illustrating the mathematical ratios used to calculate a distance to the target illustrated in FIG. 1A.

The math behind the calculation is based on simple ratios of triangles and can be understood by consideration of the exemplary unit circle depicted in FIG. 1B. As outlined above, the illustrative target's actual height is known to be two yards and the target's height as viewed through the scope reticule is measured at five mils. Therefore, because five mils is known to correlate to a five yard tall object at 1000 yards, a Y/X ratio for the triangles depicted in FIG. 1B is established as 5/1000. Thus, because the 2 yard tall object (the human target) also takes up five mils when viewed through the exemplary scope reticule, the equation 5/1000=2/X can be solved using cross multiplication to arrive at the four hundred yard distance.

Again, the calculated distance is only as accurate as the estimate of the target's actual height and the estimate of how many mils the figure takes up in the reticule. Clearly, in FIG. 1A the target takes up exactly five mils. But, consider a more likely scenario wherein the mil height estimation is not so clear. Modifying the example articulated above, suppose that the marksman estimated that the target took up five mils in the reticule when, in actuality, the target only had a mil height of 4.8 mils. Using the math above, the marksman would calculate a four hundred yard distance to the target when the actual distance is almost 417 yards (4.8/1000=2/X). That seventeen yard miscalculation, depending on the ballistic trajectory of the bullet, could result in a huge miss.

Returning to a marksman who has successfully ranged the illustrative target to four hundred yards, he can refer to his DOPE data to determine a ballistic solution. As described prior, a marksman will zero his weapon at a given distance and the DOPE data that he collects subsequent to zeroing the weapon will record the ballistic performance of the bullet beyond the zero range. Therefore, assuming all ambient conditions are consistent with the conditions at which the weapon was zeroed, the marksman need only to adjust his elevation such that the trajectory of the bullet will hit the target that he now knows is four hundred yards away.

To adjust his scope settings off of the zero settings for the exemplary four hundred yard shot, the marksman will have determined that the rifle needs to be raised by a certain angle or, alternatively, the lenses internal to the scope adjusted by a certain angle (thus serving to cause the marksman to raise the rifle in order to place the crosshairs on the target). The angle of adjustment is commonly measured in the art as either minutes of angle (MOA) or MILS. Regardless of units, the angle of adjustment can be calculated using trigonometry based on tangents, as the legs of the triangle depicted in FIG. 1B are known to one of ordinary skill in the art.

One of ordinary skill in the art will understand that the ballistic solution is greatly impacted if the distance to target is inaccurate. The mathematical calculations usually work out nicely for the FIG. 1 example, but it should be understood that it was based on two estimations left up to the judgment of the marksman—the target's height and the number of mils the target took up in the reticule. More specifically, the target in the illustration took up exactly five mils in the illustrative scope reticule, but such an exact measurement is rare in reality. More often than not, the marksman is required to estimate where between the reticule markings 15 a target falls. Moreover, to mil the target accurately, the marksman also has to hold one reticule marking 15 exactly at one end of the target while he estimates where the other end of the target falls. A guess for a target height taking up a guessed amount of mils in a scope reticule will inevitably result in inconsistent ranging calculations. Consequently, if the range is miscalculated, then the ballistic solution derived from the DOPE table will not be very useful. This common field scenario often results in missed targets on the first shot, with subsequent adjustments required until the target is eventually hit.

As described above, inaccurate ranging of a target is only one thing that can throw off a long range shot. Even assuming that a target is accurately ranged, it is inevitable that the actual field conditions of the shot will vary from the shot conditions recorded in the marksman's DOPE book. Crosswinds, humidity, altitude, temperature and barometric pressure all have an effect on a bullet's flight and significant changes in any of these field conditions will cause the ballistic trajectory of a bullet to vary at a set distance. Therefore, accurate measurement or estimation of field conditions is also essential in order to arrive at a ballistic solution that will hit an accurately ranged target.

Advantageously, embodiments of a ballistic solutions device drastically reduce marksman error in milling targets, thus delivering consistently accurate distances to target. Additionally, embodiments of a ballistic solutions device may also comprise features and aspects that enable a user to leverage available real-time field data such that error associated with those variables is minimized prior to calculating a comprehensive ballistic solution.

One exemplary embodiment of a ballistic solution device comprises an inclinometer and is mechanically coupled to an optical viewing device useful for demarcating the height of an object. Notably, one of ordinary skill in the art will understand that an optical viewing device useful for demarcating the height of an object may be a device comprised of lenses and reticules, a rifle with a scope, a bow, a pair of binoculars, a user's arm, or even a stick. Also, it will be understood that the use of the term "inclinometer" within the context of a ballistics solutions device anticipates any rotational and/or translational measurement device including, but not limited to, an inclinometer, an accelerometer, a gyroscope, etc. Moreover, it is envisioned that an inclinometer or the like may be of a single axis or multiple axis type, may use an internal reference for measurement, or may be configured to provide an analog or digital output.

Because the exemplary ballistic solution device is mechanically coupled to the secondary device, articulation of the secondary device through an angular rotation can be measured by the inclinometer. One of ordinary in the art will understand that such an embodiment is useful for the accurate calculation of a distance to target because error in "milling" the target can be drastically reduced compared to existing methods.

Consider the scenario in which a marksman estimates the number of mils in a reticule that are taken up by a target. With a ballistic solution device comprising an inclinometer and mechanically coupled to the marksman's weapon, the graduated reticule markings 15 are not required for ranging the target. The marksman needs only to place the single reticule marking at the bottom of the target and then rotate to the top of the target—the inclinometer can measure the angular rotation of the marksman's rifle as the reticule marking is translated. The accuracy of the marksman's crosshair translation from the bottom to the top (or the top to the bottom) of the target is drastically improved over the estimation of how many mils the target would take up in the reticule. With the angle known via the inclinometer, and the target height known or estimated, the distance can be calculated via the tangent function of the angle.

Notably, it will be understood that a ballistic solutions device with an inclinometer may also be used to accurately calculate the height of an object at a known distance. For example, if the distance to an object is known, the methodology described above could be used to "mil" the object, whereby the tangent function could be employed to solve for the object height.

As just described, an embodiment of a ballistic solutions device comprising an inclinometer can be used to accurately calculate a distance to target. Subsequently, the distance to target can be used in connection with a marksman's DOPE data in order to calculate a ballistic solution. One of ordinary skill in the art will appreciate that a marksman's DOPE data is often not comprehensive and, as such, the marksman must make judgments as to how actual field condition variables may affect the bullet's trajectory. Advantageously, some embodiments of a ballistic solutions device further comprise integrated DOPE data, means for manual input of field conditions or estimations and/or sensors configured to collect real-time field condition data so that a comprehensive ballistic solution can be provided to the marksman.

For example, some embodiments of a ballistic solutions device, in addition to comprising an inclinometer, may also be configured to receive user inputs of field conditions such as, for example, crosswind strength. Additionally, some embodiments configured to provide a comprehensive ballistic solution may be configured to receive and reference standard DOPE data for given calibers or custom DOPE provided by the marksman. Also, some embodiments may comprise sensors configured to measure any number of field conditions including, but not limited to, altitude, barometric pressure, humidity, coriolis and temperature.

It will be understood that exemplary embodiments of a ballistics solutions device may comprise all, or just some, of the features and aspects outlined above and below. A particular exemplary embodiment configured to receive Data Observed from Prior Engagements (DOPE) may leverage user inputs and/or sensor inputs, in conjunction with the calculated range from the inclinometer, via in order to arrive at a comprehensive ballistic solution. That is, by incorporating the known and accurately estimated data, the DOPE may be algorithmically manipulated such that an accurate ballistic solution is delivered. Notably, while much of the ballistic algorithms that may be applied to DOPE data in order to calculate a ballistic solution based on field condition variables are known, the accuracy of the measurement of the field conditions directly correlates with the accuracy of the resulting ballistic solution. As such, one of ordinary skill in the art will recognize that exemplary embodiments of a ballistic solution device that comprise real-time sensors configured to measure field variables may deliver more accurate ballistic solutions than devices presently used in the art which require the user to estimate those field variables. Of course, it will also be understood that various embodiments of a ballistics solutions device may be configured such that the user can override or eliminate the consideration of a sensor input in favor of a manual input or none at all.

Outputs or deliverables generated by various embodiments of a ballistic solutions device include, but are not limited to, a MIL card, a range card, an updated DOPE card, scope setting adjustments, aiming or "holdover" recommendations, etc. With regards to the various outputs, a marksman may employ a ballistic solutions device to generate shot-specific data or entire data cards based on pre-input manual and measured variables.

As an example, a marksman may input known or estimated field conditions, such as crosswind strength, and, in conjunction with sensor inputs from sensors comprised within the exemplary ballistic solutions device, a comprehensive card may be generated for those specific conditions, wherein the card is generated from a stored baseline ballistic curve or baseline DOPE data that has been adjusted in light of the various inputs. The card may relay the adjusted data in terms of distance to target, MILS, MOA or the like.

Advantageously, embodiments that are configured to output a card can provide a marksman with accurate adjustments to existing DOPE such that the marksman is not required to calculate those adjustments on a shot by shot basis. Moreover, other exemplary embodiments may generate a shot-specific output from pre-loaded manual and sensor inputs such that the marksman needs only to use the inclinometer functionality of the ballistic solutions device in order to trigger a real-time, shot-specific solution.

Regardless of the output of a given embodiment of a ballistic solutions device, one of ordinary skill in the art will appreciate and understand that various exemplary embodiments of a ballistic solutions device may provide for different methods of solution implementation. For example, some exemplary embodiments may provide an output measured in MILS whereby the marksman is required to use a scope's reticule markings 15 to "holdover" the target at a certain number of mils. Other exemplary embodiments may require the marksman to actually adjust the scope's DLOS such that the new settings cause the crosshairs to correspond to the given target sought to be engaged. Still other embodiments may cause the ballistic solution to be employed by automatic adjustment of the scope's erector assembly or lenses from the zero settings. As an alternative to adjusting a scope's erector assembly or lenses from the zero settings, other embodiments of a ballistic solutions device may cause a ballistic solution to be implemented via automatic adjustment of the base mechanism used to couple a scope to a rifle. Such exemplary embodiments that may be configured to adjust the scope mounting mechanism may comprise motors or manual gearing for manipulation of the scope's position relative to the center line of the rifle's bore, thereby alleviating the need to change a scope's initial elevation and windage settings.

Moreover, various exemplary embodiments of a ballistic solutions device may be employed separately from the rifle or other projectile launching device that will be used to implement calculated ballistic solutions. Still other exemplary embodiments may be integrated into a rifle, a scope coupled to a rifle or the mounting mechanism between a rifle and scope. Additionally, some exemplary embodiments may be configured to be used separately from a rifle or in direct communication with a rifle, as may be preferred by the user. It is also envisioned that some exemplary embodiments will comprise "quick disconnect" features or aspects that provide for the coupling and decoupling of the embodiment to a rifle or other device.

Turning now to FIGS. 2 through 11, where like reference numerals represent like elements throughout the drawings, various aspects, features and embodiments of exemplary ballistic solutions devices and methods will be presented in more detail. The examples as set forth in the drawings and detailed description are provided by way of explanation and are not meant as limitations on the scope of a ballistics solutions device, the methods for using a ballistic solutions device or the outputs that may be generated by a ballistic solutions device. A ballistics solutions device thus includes any modifications and variations of the following examples as come within the scope of the appended claims and their equivalents.

Figure 2:
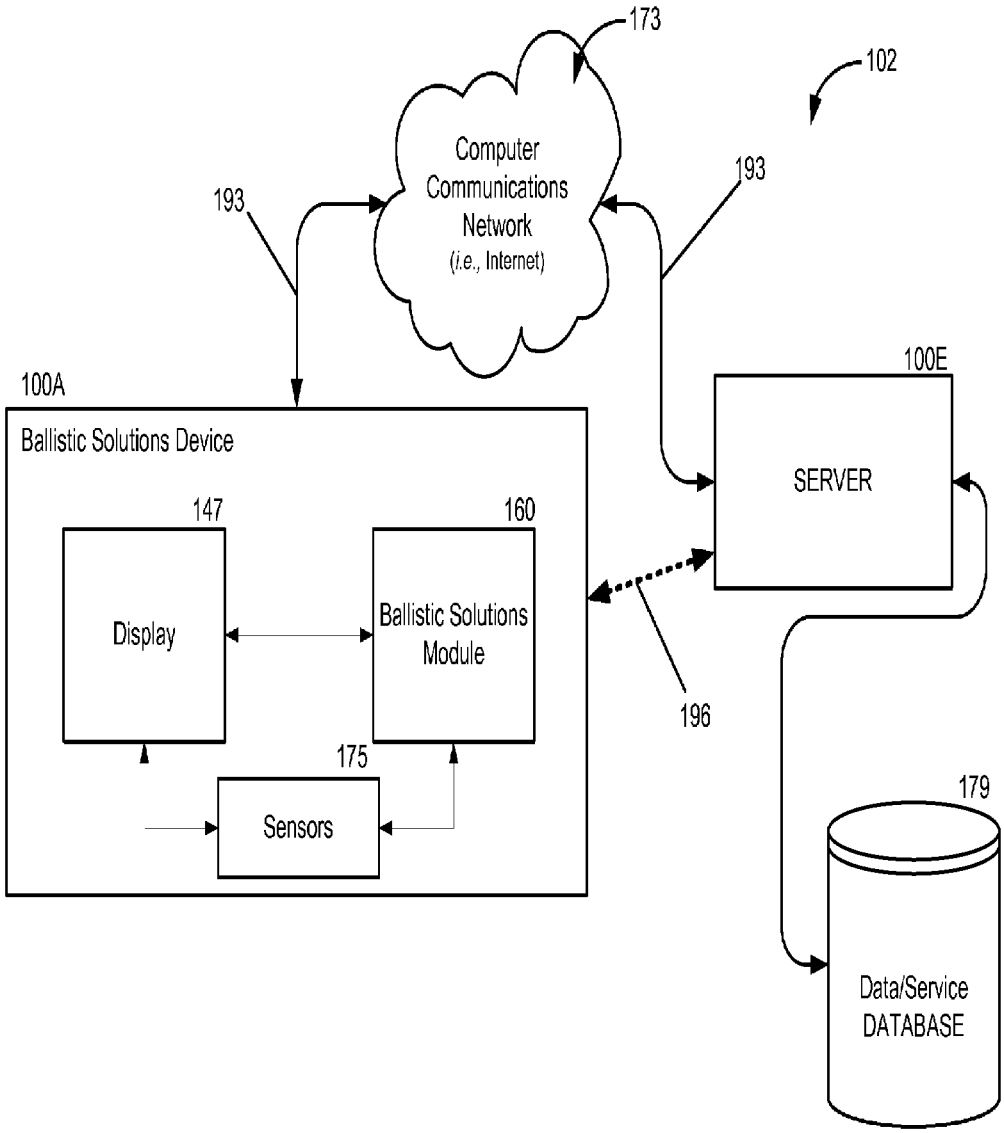
FIG. 2 is a functional block diagram of an exemplary computer system for a ballistic solutions device.

FIG. 2 is a functional block diagram of an exemplary computer system 102 for a ballistic solutions device 100A. Exemplary embodiments of a ballistic solutions device 100A that are configurable per the illustrated system 102 anticipate remote communication, real-time software updates, extended data storage, etc. Advantageously, embodiments configured for communication via a computer system such as the exemplary system 102 depicted in FIG. 2 may leverage the Internet for, among other things, geographical information, real-time barometric readings, weather forecasts, real-time or historical temperate, etc. Other data that may be useful in connection with a ballistic solutions device 100A, and accessible via the Internet or other networked system, will occur to those with ordinary skill in the art.

The computer system 102 can comprise a server 100E which can be coupled to a network 173 that can comprise a wide area network ("WAN"), a local area network ("LAN"), the Internet, or a combination of networks. The server 100E can be coupled to a data/service database 179. The data/service database 179 can store various records related to, but not limited to, device configurations, software updates, user's manuals, troubleshooting manuals, Software as a Service (SaS) functionality, customized device configurations for specific weapons or terrain, user-specific configurations, baseline DOPE, updated DOPE, previously uploaded DOPE, real-time DOPE, real-time weather data, target specific information, target coordinates, target altitude, target speed, etc. Advantageously, in some embodiments, users may download data from data/service database 179 at any time before engaging a target or, alternatively, in real-time.

The server 100E can be coupled to the network 173. Through the network 173, the server 100E can communicate with various different ballistic solutions devices 100A that may be comprised of desktop or laptop computers or other devices. Each ballistic solutions device 100A can run or execute web browsing software in order to access the server 100E and its various applications. The ballistic solutions devices 100A can take on many different forms such as desktop computers, laptop computers, handheld devices such as personal digital assistance ("PDAs"), in addition to other smart devices such as cellular telephones. Any device which can access the network 173, whether directly or via tether to a complimentary device, can be a ballistic solutions device 100A according to the computer system 102. The ballistic solutions devices 100A can be coupled to the network 173 by various types of communication links 193. These communication links 193 can comprise wired as well as wireless links. The communication links 193 allow each of the ballistic solutions devices 100A to establish virtual links 196 with the server 100E.

Each ballistic solutions device 100A preferably comprises a display 147 and one or more sensors 175. The sensors 175 can capture any number of field conditions and/or conditions directly attributable to the rifle/scope to which it is coupled such as, but not limited to, the angle of the rifle relative to horizontal, the position of the rifle relative to the equator and the cant or tilt of the rifle relative to vertical or some other reference. The sensor inputs, as well as other manual inputs in some embodiments, can be used to calculate a ballistic solution for rendering on the display 147. With regards to the display of a ballistic solutions device, it is envisioned that the display 147 can comprise any type of display device such as a liquid crystal display (LCD), a plasma display, an organic light-emitting diode (OLED) display, and a cathode ray tube (CRT) display.

A ballistic solutions device 100A can execute or run a ballistic solutions software module 160. The ballistic solutions software module 160 may comprise a multimedia platform that can be part of a plug-in for an Internet web browser. The ballistic solutions software module 160 is designed to work with the sensors 175, manual inputs, the display 147, and any stored DOPE in order to produce a ballistic solution on the display 147. In addition, in some embodiments, computer generated animation may be leveraged to render a ballistic solution on the display 147. Specifically, the ballistic solutions software module 160 monitors signals from the sensors 175 in order to detect real-time ambient conditions and rifle-specific data (such as translation of the rifle through an arc of movement when "milling" a target). Once the real-time ambient conditions and rifle-specific data is detected by the ballistic solutions software module 160, the ballistic solutions software module 160 may run ballistic calculation algorithms to arrive at a ballistic solution.

Figure 3:
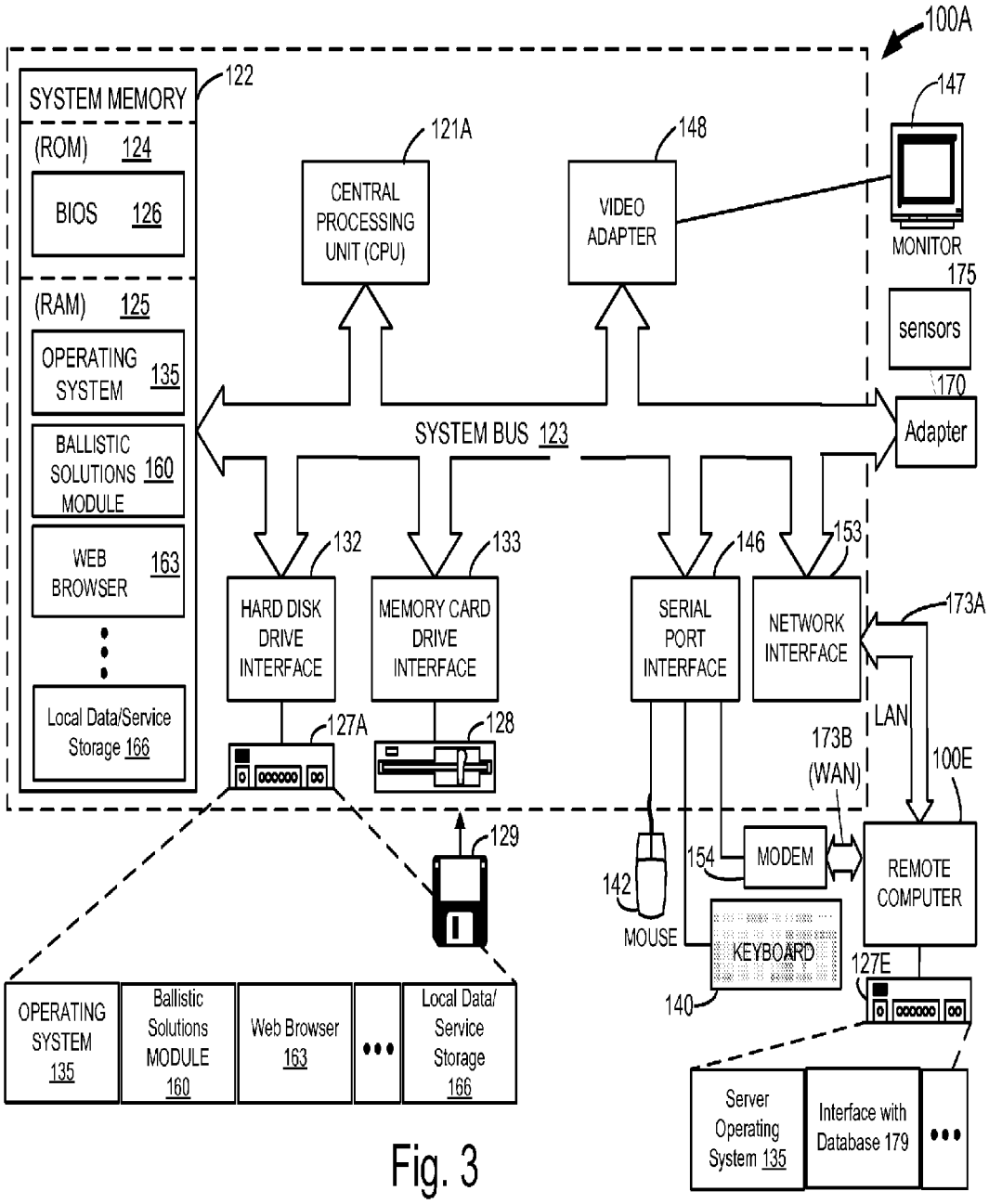
FIG. 3 is a functional block diagram of a ballistic solutions device that can be used in the FIG. 2 system for creating a ballistic solution according to an exemplary embodiment of the invention.

FIG. 3 is a functional block diagram of a ballistic solutions device 100A, for example, a computer, and that can be used in the system 102 for creating a ballistic solution according to an exemplary embodiment of the invention. The exemplary operating environment for the system 102 includes a general-purpose computing device in the form of a conventional computer. Notably, although a conventional computer is described relative to the FIG. 3 illustration, it is envisioned that single chip solutions may be used in some embodiments. Generally, the ballistic solutions device 100A includes a processing unit 121, a system memory 122, and a system bus 123 that couples various system components including the system memory 122 to the processing unit 121.

The system bus 123 may be any of several types of bus structures including a memory bus or memory controller, a peripheral bus, and a local bus using any of a variety of bus architectures. The system memory includes a read-only memory (ROM) 124 and a random access memory (RAM) 125. A basic input/output system (BIOS) 126, containing the basic routines that help to transfer information between elements within ballistic solutions device 100A, such as during start-up, is stored in ROM 124.

The ballistic solutions device 100A, which may be a computer, can include a hard disk drive 127A for reading from and writing to a hard disk, not shown, and a memory card drive 128 for reading from or writing to a removable memory 129, such as, but not limited to, a memory card, a non-volatile memory card, a secure digital card (SD, SDHC, SDXC, miniSD, etc.), a memory stick, a compact flash memory (CF), a multi media card (MMC), a smart media card (SM), an xD-Picture card (xD), a Microdrive card, an EPROM non-volatile memory, an EEPROM non-volatile memory, or the like. Hard disk drive 127A and memory card drive 128 are connected to system bus 123 by a hard disk drive interface 132, and a memory card drive interface 133, respectively.

Although the exemplary environment described herein employs a hard disk 127A, and a removable memory card 129, it should be appreciated by those skilled in the art that other types of computer readable media which can store data that is accessible by a computer, such as magnetic cassettes, flash memory cards, digital video disks, Bernoulli cartridges, RAMs, ROMs, and the like, may also be used in the exemplary operating environment without departing from the scope of the invention. Such uses of other forms of computer readable media besides the hardware illustrated will be used in smaller ballistic solutions devices 100A such as in cellular phones and/or personal digital assistants (PDAs). The drives and their associated computer readable media illustrated in FIG. 3 provide nonvolatile storage of computer-executable instructions, data structures, program modules, and other data for computer or ballistic solutions device 100A.

A number of program modules may be stored on hard disk 127, memory card 129, ROM 124, or RAM 125, including an operating system 135, a ballistic solutions software module 160, a web browser 163, and a local data/service database 166. Program modules include routines, sub-routines, programs, objects, components, data structures, etc., which perform particular tasks or implement particular abstract data types. Aspects of the present invention may be implemented in the form of a downloadable, client-side, browser based ballistic solutions software module 160 which is executed by the central processing unit 121A of the ballistic solutions device 100A in order to provide a ballistic solution.

A user may enter commands and information into a ballistic solutions device 100A through input devices, such as a keyboard 140 and a pointing device 142. Pointing devices may include a mouse, a trackball, and an electronic pen that can be used in conjunction with an electronic tablet. Other input devices (not shown) may include a microphone, joystick, game pad, satellite dish, scanner, or the like. These and other input devices are often connected directly to processing unit 121 in some embodiments or, alternatively, may be connected through a serial port interface 146 that is coupled to the system bus 123, but may be connected by other interfaces, such as a parallel port, game port, a universal serial bus (USB), wireless port or the like.

The display 147 may also be connected to system bus 123 via an interface, such as a video adapter 148. As noted above, the display 147 can comprise any type of display devices such as a liquid crystal display (LCD), a plasma display, an organic light-emitting diode (OLED) display, and a cathode ray tube (CRT) display.

The sensors 175 may also be connected to system bus 123 via an interface, such as an adapter 170. Among other sensing devices, the sensors 175 can comprise a video camera such as a webcam and can be a CCD (charge-coupled device) camera or a CMOS (complementary metal-oxide-semiconductor) camera. In addition to the monitor 147 and sensors 175, the ballistic solutions device 100A, comprising a computer, may include other peripheral output devices (not shown), such as speakers and printers. Also, it will be understood that sensors 175 may be comprised within the housing of an embodiment of a ballistic solutions device 100A or, alternatively, communicably coupled to an embodiment of a ballistic solutions device 110A.

The ballistic solutions device 100A, comprising a computer, may operate in a networked environment using logical connections to one or more remote computers, such as the server 100E. A remote computer may be another personal computer, a server, a client, a router, a network PC, a peer device, or other common network node. While the server 100E or a remote computer typically includes many or all of the elements described above relative to the ballistic solutions device 100A, only a memory storage device 127E has been illustrated in the Figure. The logical connections depicted in the Figure include a local area network (LAN) 173A and a wide area network (WAN) 173B. Such networking environments are commonplace in offices, enterprise-wide computer networks, satellite networks, telecommunications networks, intranets, and the Internet.

When used in a LAN networking environment, the ballistic solutions device 100A, comprising a computer, may be coupled to the local area network 173A through a network interface or adapter 153. When used in a WAN networking environment, the ballistic solutions device 100A, comprising a computer, typically includes a modem 154 or other means for establishing communications over WAN 173B, such as the Internet. Modem 154, which may be internal or external, is connected to system bus 123 via serial port interface 146. In a networked environment, program modules depicted relative to the server 100E, or portions thereof, may be stored in the remote memory storage device 127E. It will be appreciated that the network connections shown are exemplary and other means of establishing a communications link between the computers may be used.

Moreover, those skilled in the art will appreciate that the present invention may be implemented in other computer system configurations, including hand-held devices, multiprocessor systems, microprocessor based or programmable consumer electronics, network personal computers, minicomputers, mainframe computers, and the like. The invention may also be practiced in distributed computing environments, where tasks are performed by remote processing devices that are linked through a communications network. In a distributed computing environment, program modules may be located in both local and remote memory storage devices.

Figure 4:
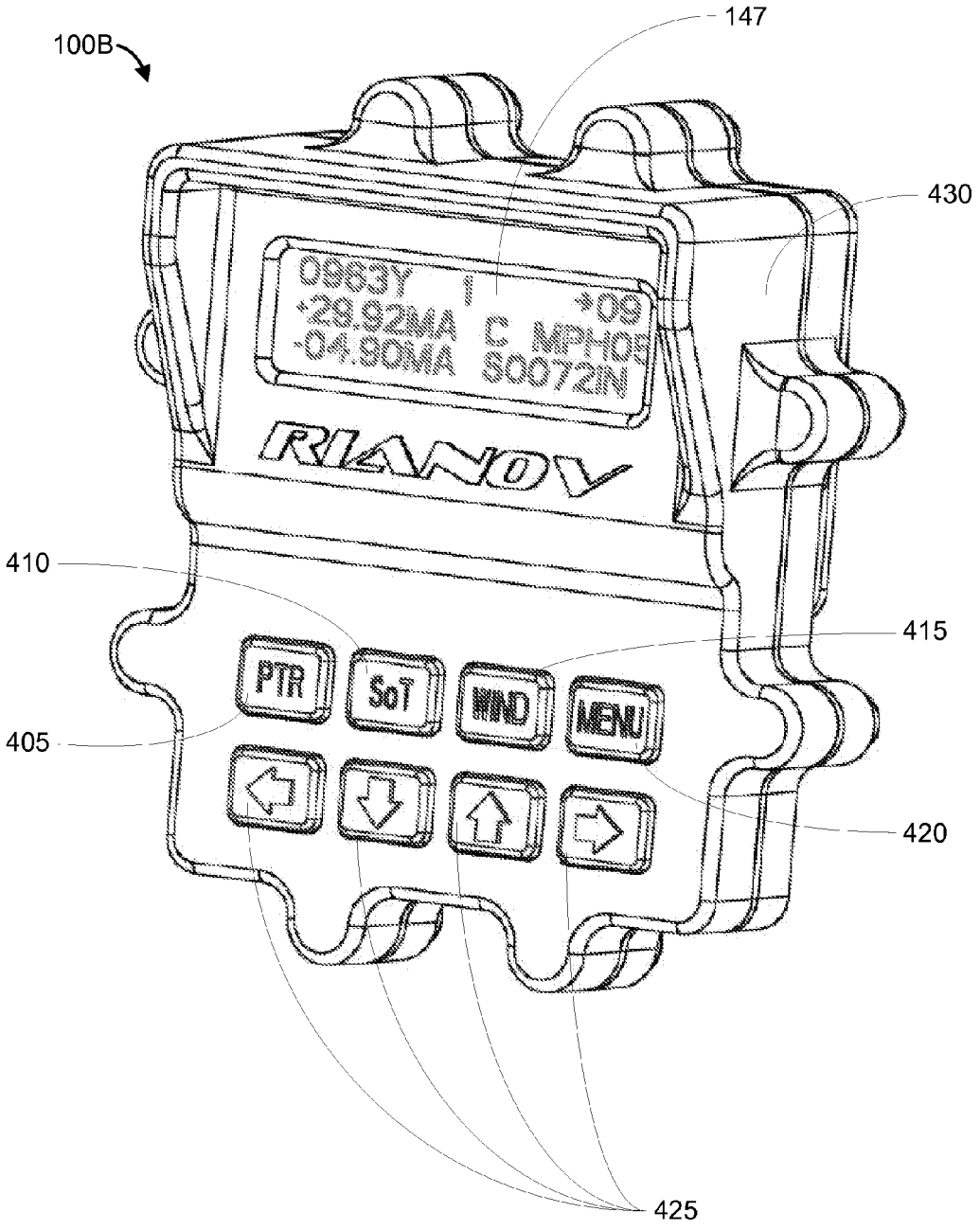
FIG. 4 depicts an exemplary embodiment of a ballistic solutions device.

FIG. 4 depicts an exemplary embodiment of ballistic solutions device 100B. The particular exemplary embodiment illustrated is comprised of a single housing 430 configured for coupling to a rifle/scope or other optical viewing device. Ballistic solutions generated by the FIG. 4 embodiment may be rendered to the user via the integrated display 147. Generally, various values may be entered, and options or configurations may be accessed or selected, by a user via a menu button 420 and navigation buttons 425. Moreover, the particular embodiment depicted comprises a "push to range (PTR)" button 405 and a "size of target (SoT)" button 410 configured for user entry of values used for ballistic solution calculation. Notably, although the input mechanisms depicted in FIG. 4 are of a push button type, it will be understood that other embodiments may receive inputs via automatic download, synchronization, a wireless connection or the like.

Figure 5A:
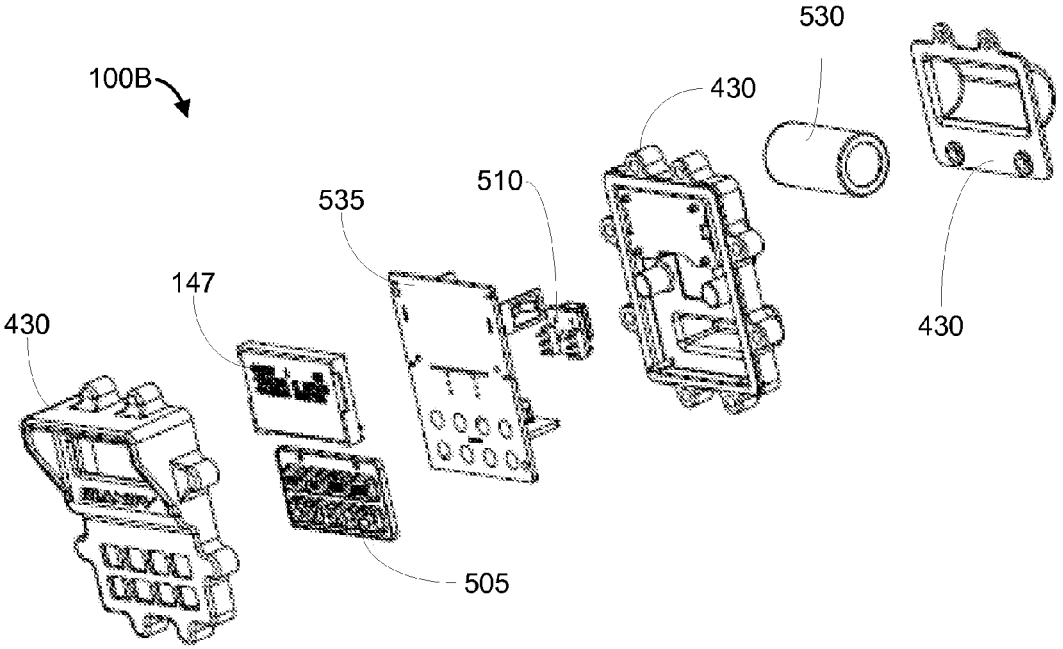
FIGS. 5A-5B collectively represent an exploded view of the exemplary embodiment of a ballistic solutions device depicted in FIG. 4.
Figure 5B:
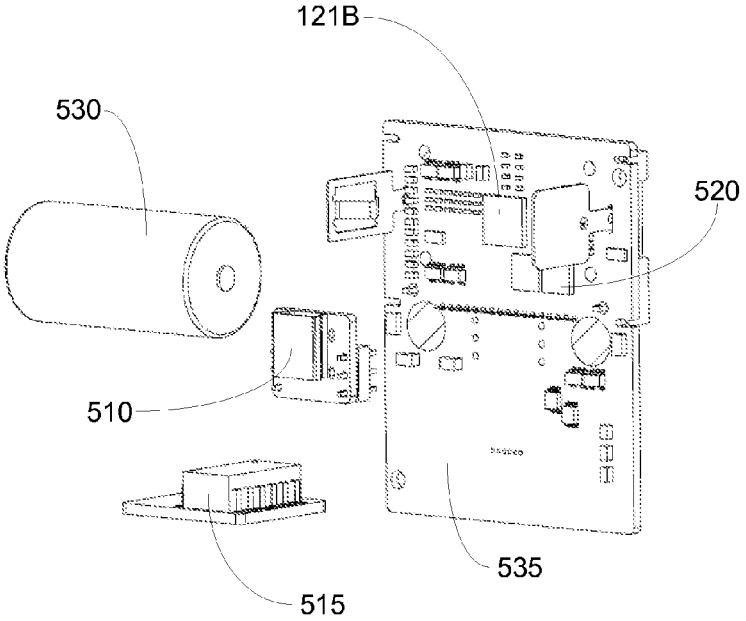

FIGS. 5A-5B collectively represent an exploded view of the exemplary embodiment of the ballistic solutions device 100B depicted in FIG. 4. FIG. 5A generally provides a view of several parts of the electronic packaging that form the ballistic solutions device 100B in which the printed circuit board 535 is illustrated with less detail. Meanwhile, FIG. 5B provides a view which further amplifies the view and details of the printed circuit board 535 that has several important components that provide functions for the ballistic solutions device 100B.

As described above, the particular embodiment 100B comprises a housing 430 configured to contain various combinations of the features, aspects and components described relative to FIGS. 2 and 3 and elsewhere. The input mechanisms depicted in the exemplary embodiment are of a keypad 505 and a universal serial bus (USB) communications port 510. The keypad 505 may be configured to receive user inputs such as, for example, target height or crosswind strength or any other data required to be entered directly into the ballistic solutions device 100 via a user. Further, the keypad 505 may be configured to provide user access to menus, submenus, user profiles, weapon profiles, etc. Likewise, the communications port 510 may be configured to receive downloaded information or other inputted information provided via a networked device, such information including, but not limited to, various forms of DOPE data.

Also comprised within embodiments of a ballistics solutions device 100 are various electronics configurations for monitoring of sensor inputs and calculation of ballistic solutions. As has been described above, many embodiments of a ballistic solutions device 100 comprise a rotational and/or translational measurement component 515 such as, but not limited to, an inclinometer. The particular inclinometer 515 used in some embodiments of a ballistic solutions device 100 is a VTI, Inc. model SCA100T-D02 capable of measuring an angular translation as small as 0.0025 degrees, however, not all embodiments will comprise an equivalent inclinometer. Advantageously, the resolution of angular measurement afforded a ballistic solutions device 100 which comprises an inclinometer 515 directly translates to more accurate distance to target calculations, as described above. Moreover, in some embodiments, 24-bit analog to digital convertors may be employed to convert the inclinometer output (or an output from another included sensor) and improve accuracy. In some embodiments, signal accuracy of the inclinometer can be improved from 0.0025 degrees to 0.00012 degrees by including a convertor component. However, it will be understood that not all embodiments include a convertor component, or other component operable to improve accuracy or performance, and, as such, the scope of a ballistic solutions device will not be limited to an accuracy level for any particular component or component combination. Further, a 24-bit analog to digital converter is offered herein for exemplary purposes only and will not be interpreted to preclude other methods of improving component performance or accuracy that may occur to those of ordinary skill in the art of electronics.

The purpose of the inclinometer 515, or other positional components, is to monitor the position and orientation of the ballistic solutions device 100, or the device to which the ballistic solutions device 100 is mechanically coupled, and provide a signal representative of such position or orientation to the ballistic solutions software module 160 (executed by a central processing unit 121B) or to other component for use in calculating either a target height or a distance to target. Notably, though the embodiment depicted in the present figure comprises the inclinometer 515 within the housing 430 of the exemplary ballistic solutions device 100B, it is envisioned that other embodiments may comprise a rotational and/or translational measurement component outside of the device housing 430. For instance, some embodiments of a ballistic solutions device 100 may have an inclinometer 515 in mechanical communication with a rifle, scope or other optical equipment and wired or wireless communication with the other components of the ballistic solutions device 100.

The exemplary embodiment 100B further comprises barometric pressure and temperature measuring devices 520 for the real-time monitoring of environmental conditions. As is known to one of ordinary skill in the art of ballistics, temperature and pressure variations have a direct impact on bullet trajectory. Generally, with lower pressure and higher temperature, a projectile will follow a "flatter" ballistic curve as it is exposed to less drag over a given horizontal distance. Conversely, higher pressures and lower temperatures cause the atmosphere to be denser, thus creating friction that slows a bullet and causes it to drop prematurely. Thus, the ramifications of temperature and pressure variations off of the conditions at which a rifle was zeroed can dramatically affect the envisioned trajectory of a bullet. As such, embodiments of a ballistic solutions device 100 monitor the pressure and temperature with the pressure and temperature measuring devices 520 so that compensations for real-time variations in those conditions can be made to baseline DOPE data, thus providing for an accurate ballistic solution.

Additionally, an energy storage device 530 is shown comprised within the exemplary embodiment 100B. It is envisioned that the energy storage device 530 may be any device capable of providing the required energy to power the ballistic solutions device 100. The energy storage device 530 is preferably a direct current energy or charge storage device that is configured to provide power. It is envisioned that the energy storage device 530 may be of any type known to one of ordinary skill in the art including, but not limited to, general purpose batteries, alkaline batteries, lead acid batteries, deep cycle batteries, rechargeable batteries, or the like. Moreover, it is envisioned that device 530 may take the form of a fuel cell or capacitor. Notably, an energy storage device 530 of a capacitor type could be employed in conjunction with a human powered crank component for supplying energy to the ballistic solutions device 100.

Signals representative of the data captured by the various sensors collectively referenced as 175 corresponding to FIG. 2, and referenced as inclinometer 515 and pressure/temperature devices 520 of FIG. 5B, may be transmitted to the central processing unit 121B via a printed circuit board 535. The central processing unit 121B can run or execute the ballistic solutions software module 160, as illustrated in FIG. 3. Exemplary printed circuit boards 535 of FIGS. 5A-5B used within various embodiments of a ballistic solutions device 100 include printed circuit lines that electrically connect the various components of the ballistic solutions device 100B.

Figure 6:
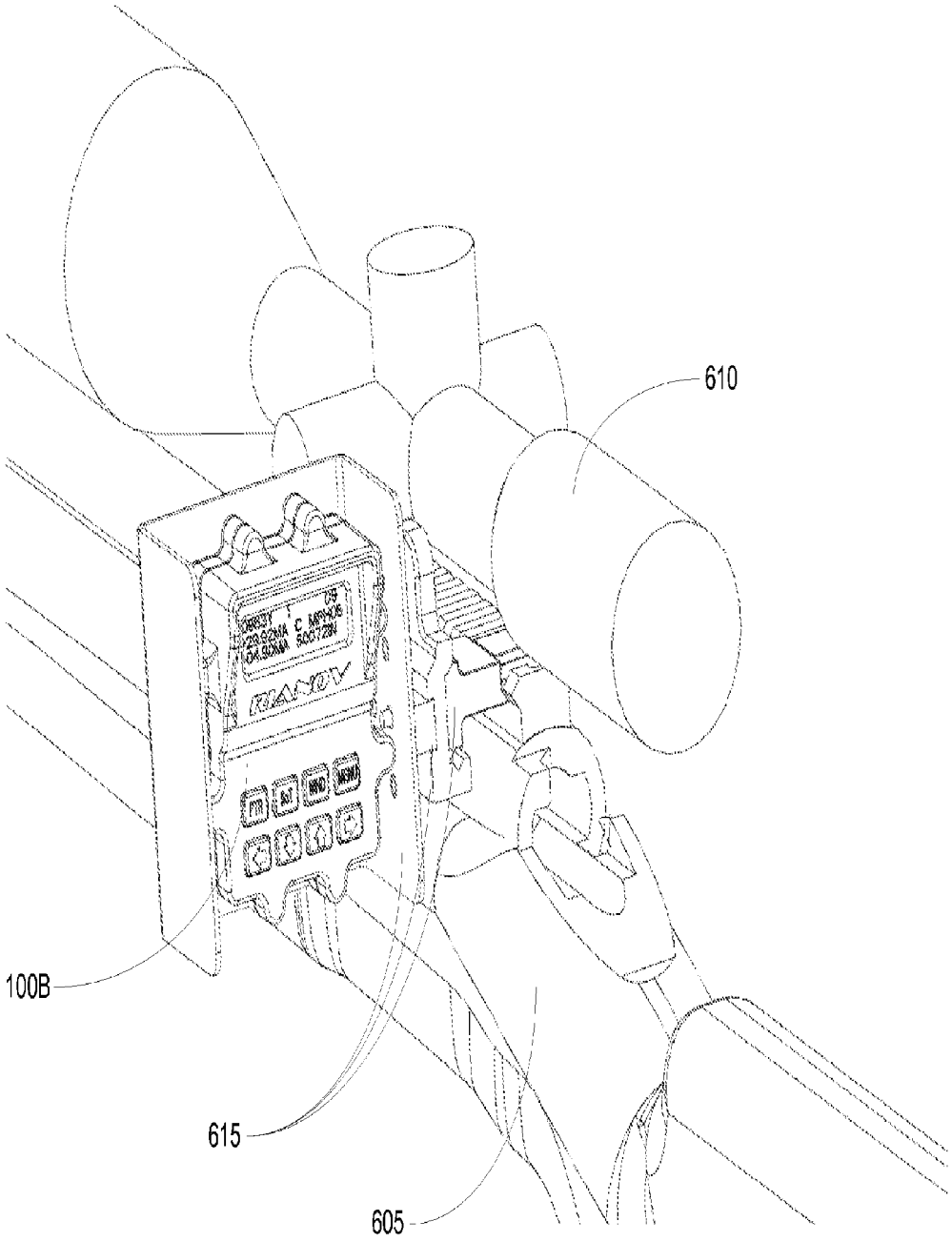
FIG. 6 depicts the exemplary embodiment of a ballistic solutions device illustrated in FIGS. 4-6, shown in mechanical communication with rifle.

FIG. 6 depicts the exemplary embodiment of a ballistic solutions device 100B illustrated in FIGS. 4-6, shown in mechanical communication with rifle. As is known in the art, the rifle 605 is in rigid communication with a scope 610 such that a translational movement of the rifle 605 will cause the scope 610 to move in concert with the rifle 605. Likewise, because the ballistic solutions device 100B is also rigidly coupled to the rifle 605 via the exemplary bracket system 615, a translational movement of the rifle 605 will also cause the inclinometer 515 to detect a range of angular motion. Similarly, one of ordinary skill in the art understands that any deviation of the rifle 605 from an upright position, i.e. upward slope, downward slope, slant, tilt or cant, may also be detected by a sensor 175 within the ballistic solutions device 100B as a degree of slope, slant, tilt or cant may cause the mechanically coupled ballistic solutions device 100B to be unlevel.

Advantageously, a ballistic solutions device 100B comprising a sensor 175 configured to measure a rifle's slope, slant, tilt or cant may consider such misalignment in the generation of a ballistic solution. For instance, one of ordinary skill in the art will understand that suggested elevation and windage adjustments taken from ballistic solution methods known in the art assume that the rifle/scope combination to which the solution will be applied is oriented in an upright position such that the scope DLOS shares a common vertical plane with a line projected from the bore of the rifle. Additionally, one of ordinary skill in the art will understand that a bullet fired along a downward slope will have a "flatter" trajectory due to the assist of gravity, as opposed to a bullet fired along an upward slope which will follow a more curved trajectory due to the force of gravity working in concert with atmospheric drag to slow the bullet's flight.

That is, with all factors held constant, an adjustment in an elevation setting, for instance, will uniquely affect the eventual point of impact on a target along a vertical axis defined by the aforementioned common plane. However, when the rifle/scope combination is held at a cant, the DLOS no longer shares a common vertical plane with a line projected from the bore of a rifle and, as such, adjustments to an elevation setting will not affect the eventual point of impact in a manner consistent with the applied ballistic solution. Similarly, a windage setting adjustment calculated under the assumption that a rifle/scope combination is oriented vertically will not be applicable to the same rifle/scope combination when held at a cant. Likewise, a ballistic solution calculated based on the assumption the target and the rifle/scope share a common altitude will not be applicable for engaging a target that resides at an altitude above or below that of the rifle/scope. Advantageously, embodiments of a ballistic solutions device may consider the slope, slant, tilt or cant of a rifle/scope combination such that a calculated ballistic solution will provide elevation and windage adjustments applicable to the actual three-dimensional orientation of the rifle/scope combination.

Certain steps in the processes or process flows described in this specification naturally precede others for the invention to function as described. However, the invention is not limited to the order of the steps described if such order or sequence does not alter the functionality of the invention. That is, it is recognized that some steps may be performed before, after, or in parallel with (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Additionally, one of ordinary skill in programming is able to write computer code or identify appropriate hardware and/or circuits to implement the disclosed invention without difficulty based on the flow charts and associated description in this specification, for example. Therefore, disclosure of a particular set of program code instructions or detailed hardware devices is not considered necessary for an adequate understanding of how to make and use the invention. The inventive functionality of the claimed computer implemented processes is explained in more detail in this description and in conjunction with the Figures which may illustrate various process flows.

In one or more exemplary aspects, the functions described may be implemented in hardware, software, firmware, or any combination thereof. That is, it is recognized that the ballistic solutions software module 160 may be implemented in firmware or hardware or a combination of software with firmware or software. If implemented in software, the functions may be stored on or transmitted as one or more instructions or code on a computer-readable medium.

Computer-readable media include both computer storage media and communication media including any medium that facilitates transfer of a computer program from one place to another. A storage media may be any available media that may be accessed by a computer. By way of example, and not limitation, such computer-readable media may comprise RAM, ROM, EPROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Figure 7:
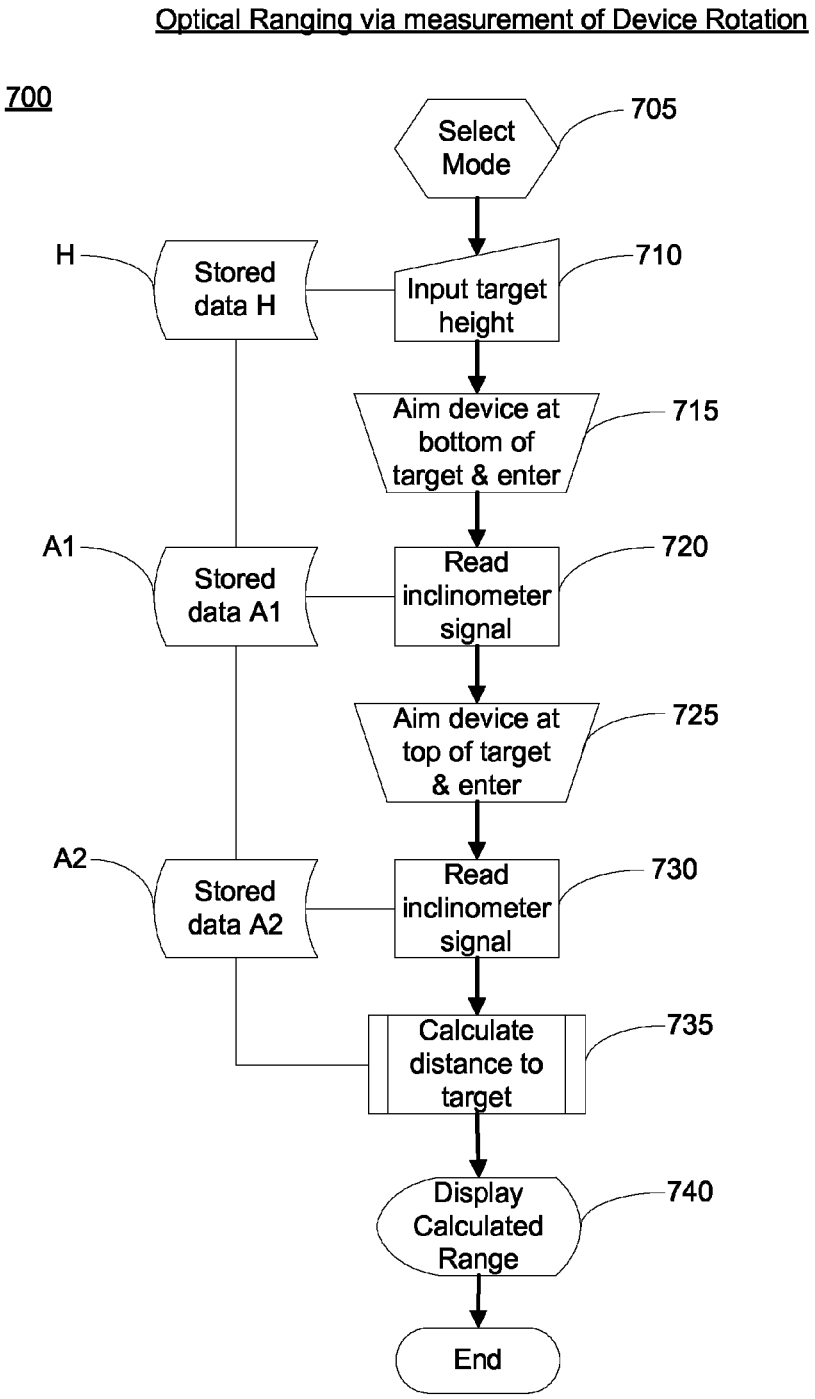
FIG. 7 is a flow chart illustrating an exemplary method for optical ranging via measurement of ballistic solutions device rotation.

FIG. 7 is a flowchart illustrating an exemplary method 700 for optical ranging via measurement of rotation of the ballistic solutions device 100. As may be required in some embodiments of the ballistic solutions device 100, a user may select in step 705 the device mode for calculating the distance to a target. As has been described, a user of a ballistic solutions device 100 seeking to determine the distance to a target 10 that has a known or closely estimated height, may view the target 10 via an optical viewing device, such as a scope 610, that is mechanically coupled to a ballistic solutions device 100 comprising an inclinometer 515.

Prior to viewing the target, or as the target is being viewed, the user may enter in step 710 the known or closely estimated target height. The ballistic solutions device 100 may store the target height as data H. At step 715, the user may aim the optical viewing device at the bottom of the target 10. Once the optical viewing device is aimed at the bottom of the target 10, the user may "enter" the data A1. Notably, once the optical viewing device is aimed in step 715 at the base of the target 10, the inclinometer 515 has established a signal representative of such position, the signal being read in step 720 by the ballistic solutions software module 160 and stored as data A1.

As the user causes the aim of the optical viewing device to translate from the bottom of the target 10 in step 715 to the top of the target 10 in step 725 by raising the optical viewing device, the inclinometer 515 measures the translation of movement. Once positioned at the top of the target, in step 725, the user may "enter" the data A2. Again, the inclinometer 515 has established a signal representative of such position, the signal being read in step 730 by the ballistic solutions software module 160 and stored as data A2.

Once data A1 and A2 have been established, the difference between them is calculated as the angle of rotation required to move the aim of the optical viewing device from the bottom to the top of the target 10. This calculation is may be performed by the ballistic solutions software module 160.

Because the height of the target is known and inputted as data H, the ballistic solutions device 100, and specifically, the ballistic solutions software module 160, may be configured to calculate in routine 735 the distance to target per the mathematical algorithms described above and then output in step 740 a distance to target 10. The process or method 700 then ends after step 740.

Figure 8:
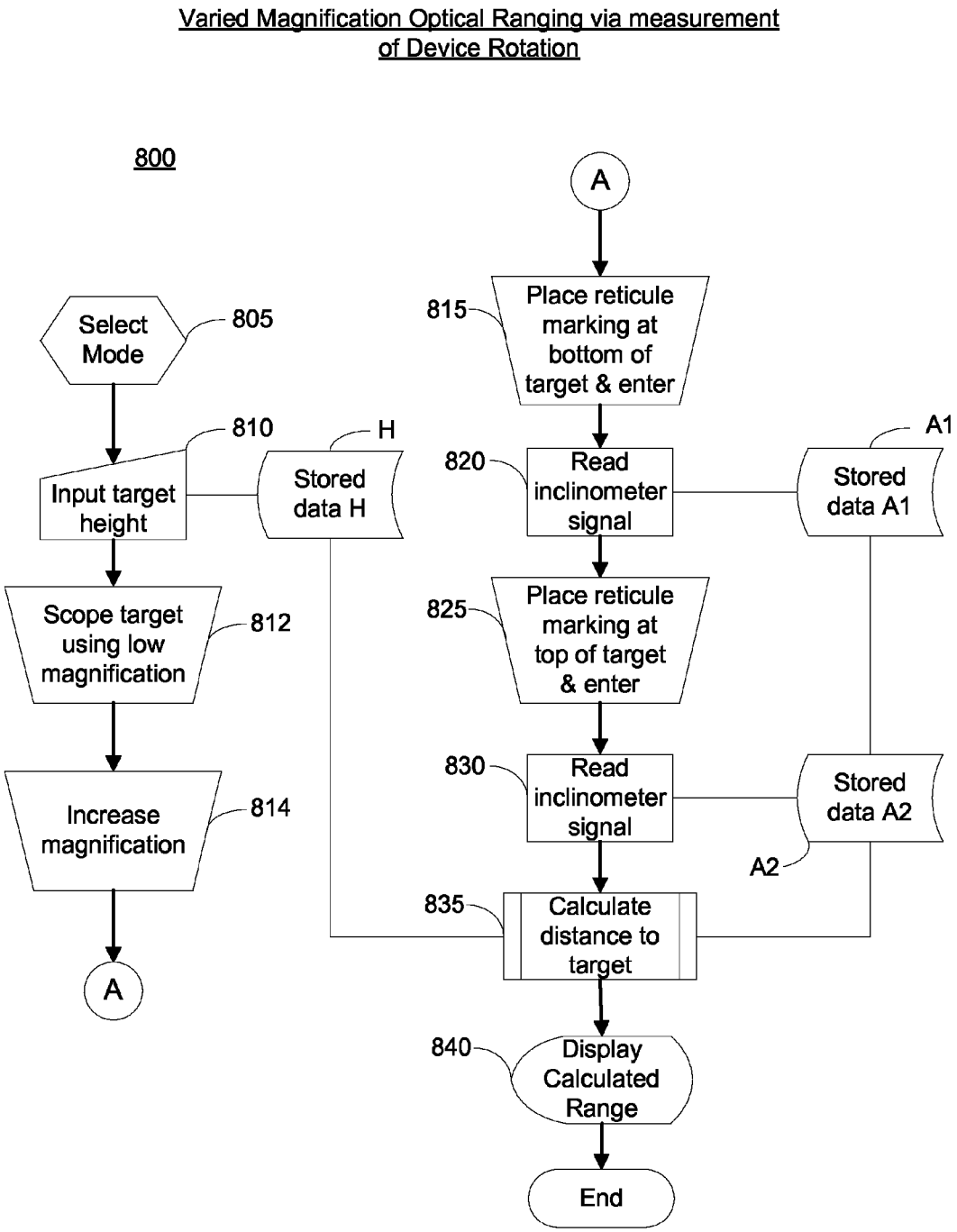
FIG. 8 is a flow chart illustrating an exemplary method for calculating a distance to target using a ballistic solutions device coupled to a variable magnification optical viewing device.

FIG. 8 is a flow chart illustrating an exemplary method 800 for calculating a distance to target 10 using a ballistic solutions device 100 coupled to a variable magnification optical viewing device, such as a scope 610. As may be required in some embodiments of a ballistic solutions device 100, a user may select in step 805 the device mode for calculating the distance to a target 10. As has been described, a user of a ballistic solutions device 100 seeking to determine the distance to a target 10 that has a known or closely estimated height, may view the target 10 via an optical viewing device, such as a scope 610, that is mechanically coupled to a projectile launching device, such as a rifle 605, and ballistic solutions device 100 comprising an inclinometer 515.

Prior to viewing the target 10, or as the target 10 is being viewed, the user may enter in step 810 the known or closely estimated target height. The ballistic solutions device 100 being may store the target height as data H. At step 812, the user may take advantage of the variable magnification of an optical viewing device by using the wide visual field of a low magnification setting to lock in on a target 10. Once the target 10 is identified using low magnification, the user may increase the magnification in step 814 in order to get a more precise resolution and a larger image of the target 10 to be engaged.

Advantageously, after step 814, a user has leveraged the low magnification of the optical viewing device to quickly and efficiently locate the target 10 and the higher magnification to lock in prior to engagement. Notably, the user is now in position to accurately place a single reticule marking 15 within the optical viewing device at one end of the target 10 without concern for calibration of reticule markings 15 to the magnification setting. That is, because the user is now in position to employ the inclinometer aspect of the ballistic solutions device 100 for the purpose of calculating a distance to target 10, there is no requirement that the target be "milled" per methods currently known to one of ordinary skill in the art and, as such, there is no need for the reticule markings 15 to be calibrated to the particular magnification setting.

Next, in step 815, the user may employ a reticule marking 15 comprised within the optical viewing device such that the marking is positioned at the bottom of the target 10. Once the marking is positioned at the bottom of the target 10, the user may "enter" the data A1. Notably, once the marking in the optical viewing device is positioned in step 815 at the base of the target 10, the inclinometer 515 has established a signal representative of such position, the signal being read in step 820 by the ballistic solutions software module 160 and stored as data A1.

As the user causes the reticule marking 15 within the optical viewing device to translate from the bottom of the target (in step 815) to the top of the target (in step 825) by raising the rifle 605 to which the optical viewing device and ballistic solutions device 100 are rigidly coupled, the inclinometer 515 measures the translation of movement. Once positioned 825 at the top of the target 10, the user may "enter" the data A2. Again, the inclinometer 515 has established a signal representative of such position, the signal being read in step 830 by the ballistic solutions software module 160 and stored as data A2.

Once data A1 and A2 have been established, the difference between them is calculated as the angle of rotation required to move the aim of the optical viewing device from the bottom to the top of the target 10. Because the height of the target 10 is known and inputted as data H, the ballistic solutions device 100, and specifically, the ballistic solutions software module 160 may be configured to calculate in routine 835 the distance to target 10 per the mathematical algorithms described above and output in step 840, such as to the display 147, a distance to target. The process or method 800 then ends.

Advantageously, calculating the distance to target using a ballistic solutions device 100 comprising an inclinometer 515 can be done with any optical viewing device that comprises a reticule marking 15. Because the user need only to cause the reticule marking 15 to translate from one end of the target 10 to the other, it is an advantage of a ballistic solutions device 100 that only a single reticule marking 15 is required in order to collect the data needed to calculate distance to target. Further, because the ballistic solutions device 100 employs an inclinometer 515 for measurement of the angular rotation (the output of which may be in MILS, MOA, radians or the like), the calibration of reticule markings 15 to a specific magnification of the optical viewing device is irrelevant.

More particularly with regards to an advantageous aspect of the angular measurement being unaffected by the magnification setting of the optical viewing device, accurate calculations of distance to target 10 may be provided by a ballistic solutions device 100 executing the ballistic solutions software module 160 regardless of the type of optical viewing device to which it is coupled. For instance, because only a single reticule marking 15 is required in order to accurately generate an angular measurement via the inclinometer 515, an optical viewing device without varying magnification may be effectively employed. Similarly, optical viewing devices of variable-magnification optics, whether of a first focal plane or second focal plane reticule configuration, may be used in conjunction with a ballistic solutions device 100 without regard for magnification settings. One of ordinary skill in the art will understand that an advantage is yet one novel aspect of the ballistic solutions device 100 as current methods for estimating distance to target (i.e., "milling" the target via calibrated reticule markings 15) usually require a user to set a specific magnification level in order to get an accurate estimation. Advantageously, because the inclinometer 515 is measuring the physical translation of the optical viewing device or rifle 605 to which it is coupled, the distance mils represented by reticule markings 15 at any given magnification is irrelevant.

Figure 9:
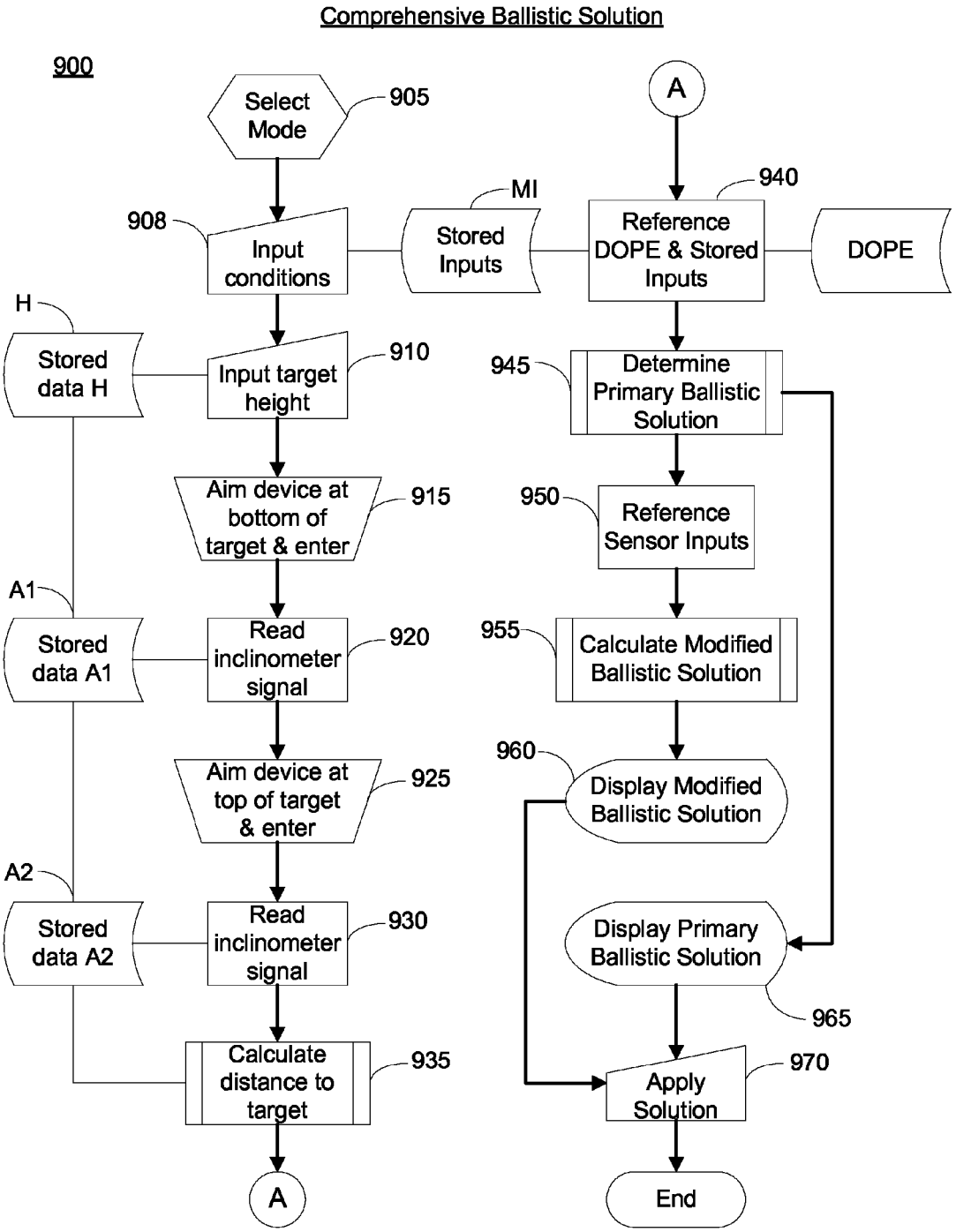
FIG. 9 is a flow chart illustrating an exemplary method for calculating a comprehensive ballistic solution using a ballistic solutions device coupled to an optical viewing device.

FIG. 9 is a flow chart illustrating an exemplary method 900 for calculating a comprehensive ballistic solution using a ballistic solutions device 100 coupled to an optical viewing device. As may be required in some embodiments of a ballistic solutions device 100, a user may select in step 905 the device mode for calculating the comprehensive ballistic solution. As has been described, a user of a ballistic solutions device 100 seeking to determine a comprehensive ballistic solution may first cause the ballistic solutions device 100 to calculate a distance to target 10. To determine the distance to a target 10 that has a known or closely estimated height, the user may view the target 10 via an optical viewing device, such as a scope 610, that is mechanically coupled to a projectile launching device, such as a rifle 605, and ballistic solutions device 100 comprising an inclinometer 515.

Prior to viewing the target 10, or as the target 10 is being viewed, the user may enter any known conditions in step 908, such as crosswind strength, and the known or closely estimated target height in step 910. The ballistic solutions device 100 may store the manually input conditions as data MI and the target height as data H. Notably, embodiments of a ballistic solutions device 100 may provide for the manual inputs MI to override sensed or calculated inputs.

At step 915, the user may employ a reticule marking 15 comprised within the optical viewing device such that the marking is positioned at the bottom of the target 10. Once the marking is positioned at the bottom of the target 10, the user may "enter" the data A1. Notably, once the marking in the optical viewing device is positioned in step 815 at the base of the target 10, the inclinometer 515 has established a signal representative of such position, the signal being read 920 by the ballistic solutions software module 160 and stored as data A1.

As the user causes the reticule marking 15 within the optical viewing device to translate from the bottom of the target 10 (in step 915) to the top of the target (in step 925) by raising the rifle 605 to which the optical viewing device and ballistic solutions device 100 are rigidly coupled, the inclinometer 515 also measures the translation of movement. Once positioned in step 925 at the top of the target, the user may "enter" the data A2. Again, the inclinometer 515 has established a signal representative of such position, the signal being read in step 930 by the ballistic solutions software module 160 and stored as data A2. It will be understood by one of ordinary skill in the art that the steps of "entering" the data A1 and A2, or any step associated with entering data into a ballistic solutions calculator via an actuation, may comprise actually pressing a key on a keypad, touching a touch screen, using a magnetic technology, employing infrared transmission, leveraging wireless transmission, or the like. Advantageously, embodiments configured to receive data input via a wireless or remote actuation alleviate measurement error that may be introduced as a result of the entire assembly (rifle, scope and ballistic solutions device 100) moving during actuation or the user losing concentration. Along these lines, some embodiments of a ballistic solutions device comprise a remote trigger mechanism in wired communication with the other components of the ballistic solutions device via a USB port/connection. Advantageously, a remote trigger mechanism may be used to enter data as well as provide a source of power such that the remainder of the ballistic solutions device is "loop powered." However, although actuation of some embodiments of a ballistic solutions device via a keypad may introduce measurement error attributable to rifle/scope/device assembly movement, other embodiments configured to receive inputs via a keypad may recognize a keypad actuation as a trigger to simply begin a measurement cycle that incorporates a delay to allow for motion settlement prior to an automatic reading/entering of data by the device.

According to one preferred and exemplary embodiment of a ballistic solutions device 100, the device 100 is configured such that data A1 and A2 are received via actuation resulting from the user simply "pausing" the reticule at the top or bottom of the target 10. Once the ballistic solutions device 100 has been set to receive the A1 and A2 data, the device 100 will record the inclinometer reading only at such time as the rifle/scope assembly to which the ballistic solutions device 100 is coupled becomes steady for a predetermined period of time, such as on the order of a few seconds or few milliseconds.

Once data A1 and A2 have been established, the difference between them is calculated by the ballistic solutions software module 160 as the angle of rotation required to move the reticule marking 15 of the optical viewing device from the bottom to the top of the target 10. Because the height of the target is known and inputted as data H, the ballistic solutions device 100, and specifically, the ballistic solutions software module 160, may be configured to calculate in routine 935 the distance to target per the mathematical algorithms described above.

It will be understood by those of ordinary skill in the art that once the distance to target 10 is determined, a basic, uncompensated ballistic solution can be provided based on known bullet trajectories. That is, a long range marksman can reference his Data Observed from Prior Engagements (DOPE) in order to determine elevation and windage adjustments required for engaging the target 10. However, a ballistic solutions device 100, and specifically, the ballistic solutions software module 160 configured to provide a comprehensive ballistic solution may modify the preliminary ballistic solution that is based only on distance to target calculations.

That is, in step 940, the ballistic solutions device 100, and specifically, the ballistic solutions software module 160 references the stored manual inputs MI and cross references in this step 940 the data with data stored DOPE associated with the calculated distance to target 10. Based on the cross-reference of manual inputs MI and DOPE associated with the distance to target 10, the ballistic solutions software module 160 may determine in routine 945 elevation and windage settings commensurate with a primary ballistic solution. Notably, some embodiments may be configured to output in step 965 this primary ballistic solution on display 147 as it is based on an accurate calculation of distance to target 10 and known DOPE. In some situations, it is envisioned that a user may not want to rely on sensor inputs, preferring instead to manually enter such data. For instance, a user seeking to engage from the top of a mountain a target located in a valley, may not want the ballistics solution device to assume a cold mountaintop temperature (however, as described above, adjustments for slant may prove advantageous in such an application).

However, in other exemplary embodiments, the ballistic solutions software module 160 may further cross-reference the DOPE with data referenced in step 950 from sensors 175 that are part of the ballistic solutions device 100 and configured to measure real-time ambient conditions. In such scenarios where it is desired, by further cross-referencing the DOPE against the sensor inputs, more precise ballistic solutions may be quickly identified or calculated by the ballistic solutions software module 160 in routine 955 and output in step 960, such as to the display 147, without relying on tedious user input.

As previously described, the comprehensive ballistic solutions/calculations may be output in any units preferred by the user, such as in MOA, MILs, inches per hundred yards, user-defined units, English, or metric units. Regardless of whether the comprehensive ballistic solution is relayed in MOA, MIL or other unit of measure recognized by one of ordinary skill in the art (such as "clicks"), the user will be in position to quickly make in step 970 the required scope adjustments or apply in step 970 the appropriate holdover. After step 970, the process or method 900 ends.

It is further envisioned that embodiments of a ballistic solutions device 100 will be configured to receive feedback after a shot is taken and thus consider the feedback in subsequent ballistic solutions. For instance, a user may enter the estimated lateral and vertical distance off target of a taken shot into a ballistic solutions device 100 and such device 100, and specifically, the ballistic solutions software module 160, may update DOPE, consider in the calculation of a subsequent solution or otherwise leverage to the benefit of the user.

Also, it is envisioned that embodiments of a ballistic solutions device 100 will "remember" a users "zero" settings and/or settings from a previous ballistic solution. As such, a user may choose to have ballistic solutions calculated from the zero settings or, alternatively, calculated from the last ballistic solution. Advantageously, calculating a ballistic solution from the zero settings may be preferred by a marksman employing the solution via reticule markings 15 in a MILDOT scope or other similar optical viewing equipment. Conversely, it may be advantageous for a marksman who prefers to adjust his elevation and windage settings (so that crosshairs can be place right on the target) to have ballistic solutions rendered in "clicks" from the last setting, thereby conceivably reducing the number of clicks required to make adjustments between shots.

Figure 10:
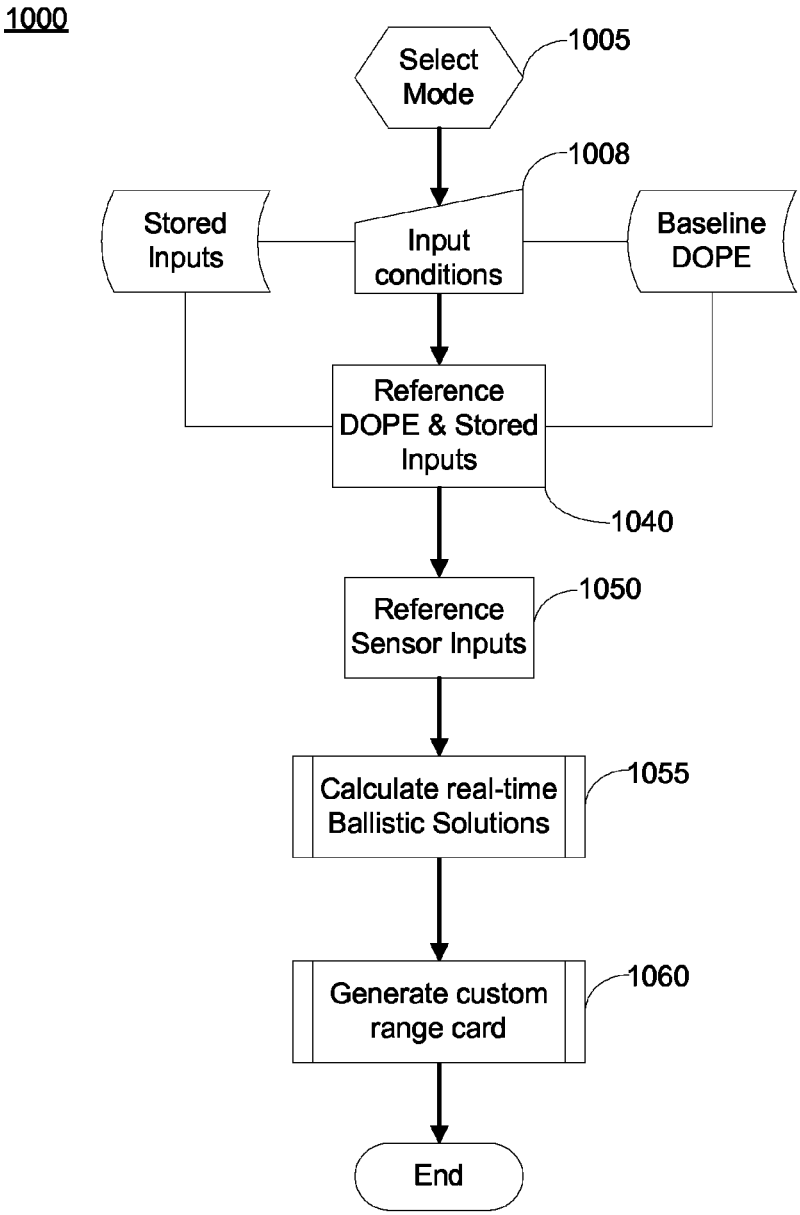
FIG. 10 is a flow chart illustrating an exemplary method for generation of a real-time ballistic solution range card using a ballistic solutions device coupled to an optical viewing device.

FIG. 10 is a flow chart illustrating an exemplary method 1000 for generating a real-time ballistic solution range card using a ballistic solutions device 100 coupled to an optical viewing device. In the conventional art, a marksman employing a range card must extrapolate or interpolate ballistic solutions from the baseline DOPE recorded in the card, wherein the extrapolations or interpolations are based on actual ambient conditions or estimations. A user of an embodiment of a ballistic solutions device 100 may leverage the device capabilities in order to generate a range card based on the actual ambient conditions, thereby providing for quick calculation of shot adjustments without requiring the user to extrapolate or interpolate ballistic solutions from his baseline DOPE.

At the initial step 1005, the user may select the mode for generating a real-time ballistic solution. One of ordinary skill in the art will recognize that mode selection is not a required aspect of all embodiments of a ballistic solutions device 100, as some devices may be configured for a single mode without further alternatives/options. At step 1008, the user may input actual ambient conditions, such as crosswind strength, and baseline DOPE. Notably, the DOPE or conditions may be entered directly by the user, synchronized from another device, downloaded via various network communications, or any other method known in the art of data transmission.

At step 1040, the ballistic solutions device 100, and specifically, the ballistic solutions software module 160 references the entered inputs and cross references in step 1040 the data to identify the baseline DOPE associated with the inputs. At step 1050, the ballistic solutions software module 160 may reference the sensor inputs, such as humidity, altitude, temperature, pressure, etc. and modify the baseline DOPE with data taken from the sensors 175 in order to calculate in routine 1055 ballistic solutions based on the update DOPE, i.e. real-time ballistic solutions. Advantageously, the real-time ballistic solutions can be subsequently rendered in routine 1060 as a comprehensive range card or on a shot-by-shot basis as the user employs the embodiment's distance to target aspects. The range card may be shown on the display 147. After routine 1060, the method or process 1000 ends.

Figure 11:
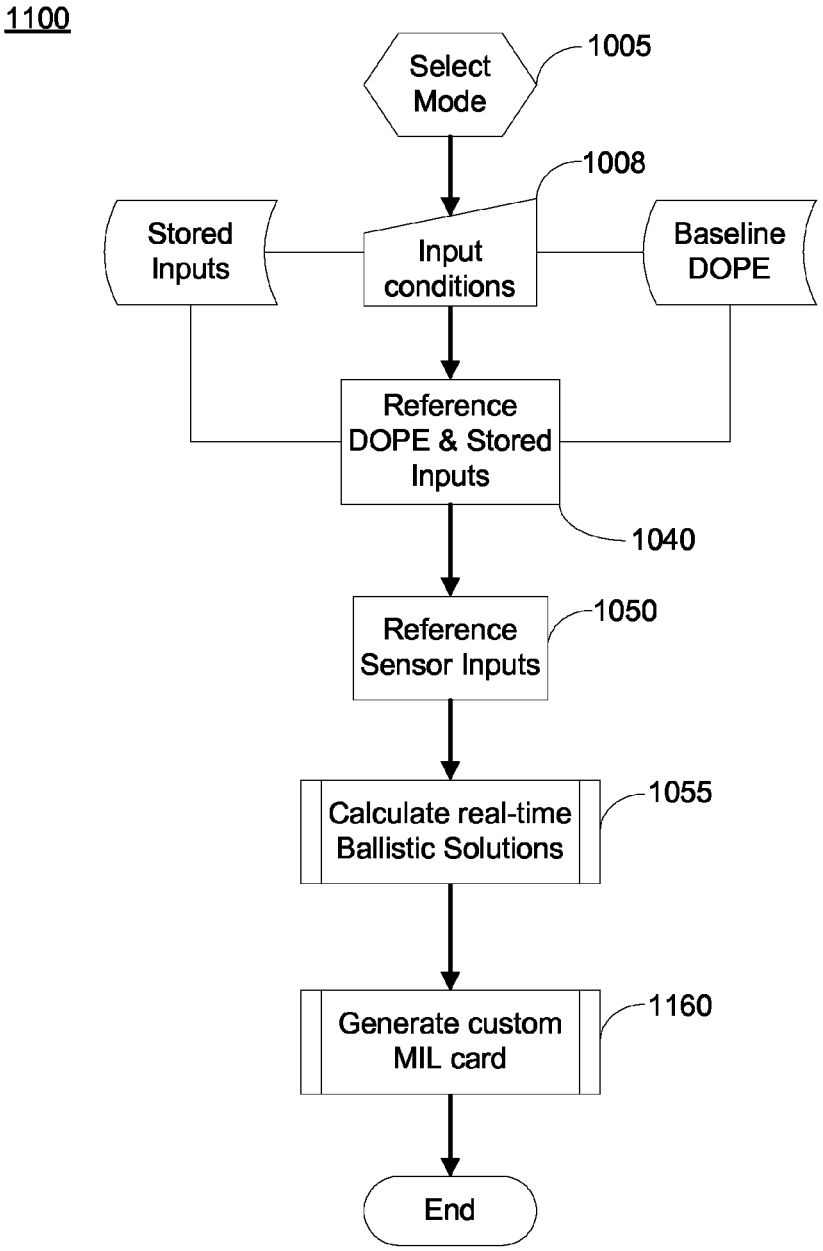
FIG. 11 illustrates an exemplary method for generation of a real-time ballistic solution MIL card using a ballistic solutions device coupled to an optical viewing device.

FIG. 11 is a flow chart illustrating an exemplary method 1100 for generating a real-time ballistic solution MIL card using a ballistic solutions device 100 coupled to an optical viewing device. The steps in method 1100 are similar to those described relative to the method illustrated in FIG. 10. Therefore, only the differences between FIGS. 10 and 11 will be described. Instead of the final output being in the form of a range card, the output is in the form of a MIL card in routine 1160 as is known in the art. This output may be shown on the display 147. After routine 1160, the process or method 1100 ends.

Notably, the illustrative outputs described relative to FIGS. 10 and 11 are offered for exemplary purposes and are not meant to limit the types of outputs that may be rendered by a given embodiment of a ballistic solutions device. A range card is a DOPE table wherein the records are organized based on increments of distance to target. Similarly, a MIL card is a DOPE table wherein the records are organized based on increments of reticule markings. For the most part, types of card outputs that may be rendered by an embodiment are limited only by the preferences of users and, as such, the specific descriptions offered herein are not scope limiting—ballistic solution output variations are envisioned. An artisan will understand that the features and aspects of a ballistic solutions device 100 may be leveraged in various embodiments to provide a user with ballistic solutions according to the preference of the user.

Additionally, one with ordinary skill in the art of long range shooting will understand that a second focal plane scope with reticule markings such as, but not limited to, a MILDOT scope, is calibrated such that at a given magnification setting (usually 10×) the distance between two reticule markings will demarcate 1 MIL (or, alternatively, 1 MOA or 1 IPHY, etc. as the case may be). Therefore, as has been described above, a user of a MILDOT scope may calculate the distance to a target of known height by setting the scope at the calibrated magnification (e.g., 10×) and estimating the number of reticule markings it takes to demarcate the height of the target. As would be understood by one of ordinary skill, the placement of the reticule markings within the scope at the time of manufacture must be very precise in order to dictate that the markings actually demarcate, for example, a MIL at 22× magnification (wherein the MIL equates to one (1) yard of height at one thousand (1000) yards of linear distance).

As has been described above, a user of an optical viewing device with reticule markings calibrated to demarcate 36" of vertical target height at a distance to target of 1000 yards, such as a MILDOT scope for example, can leverage the scope's reticule marking ratio of distance to target height (1000/36=27.7778) in order to calculate a distance to a target of a known height. That is, a user of an exemplary MILDOT scope, having determined that a 10" target is demarcated by 2 mil markings at 10× magnification, can leverage the distance/target height ratio of 27.7778 to quickly calculate that the target is 139 yards away (27.7778*10" object size/2 mils).

Considering the above example, one of ordinary skill in the art would understand that the 27.7778 ratio can only be leveraged by a user of a scope having a reticule calibrated to demarcate 36" of vertical target height at a distance of 1000 yards. Unlike methods and apparatuses known in the art, however, embodiments of a ballistic solutions device can be used in conjunction with any scope having two reticule markings (or even one marking with varying subtention, i.e. a crosshair with wide and thin areas), without regard for the distance between the reticule marks, to establish a user-defined ratio of vertical target height at a given distance. Advantageously, by providing for a user-defined ratio, a ballistic solutions device can be coupled to an inexpensive fixed power scope having at least two distinctive points of demarcation such that distances to targets of known size can be calculated.

Figure 12:
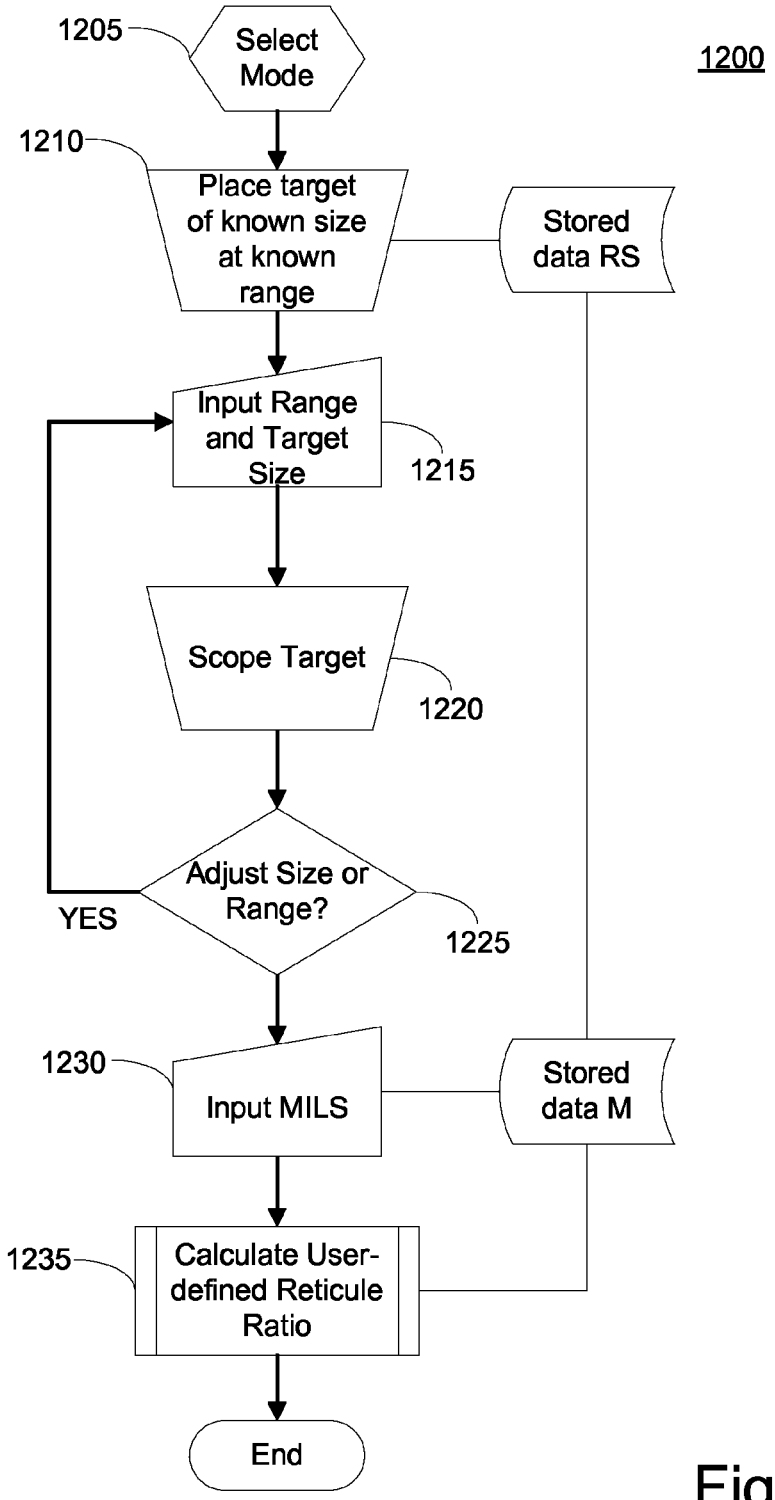
FIG. 12 is a flow chart illustrating an exemplary method for using a ballistic solutions device coupled to an optical viewing device to range a distance to target via a user-defined reticule ratio.

FIG. 12 illustrates an exemplary method 1200 for using a ballistic solutions device 100 coupled to an optical viewing device 610 with at least two distinctive points of demarcation to range a distance to target via a user-defined reticule ratio. At the initial step 1205, a user of the exemplary ballistic solutions device may select a mode for establishing a user-defined reticule marking ratio for a given optical viewing device. Once the mode is selected 1205, a user may place 1210 a target of a known size at a known distance such as, for example, a 9-inch target at a distance of 50 yards. Once placed, the user may input 1215 the known target size and distance into the exemplary ballistic solutions device 100 which will store the input range and size RS for calculation of a user-defined ratio unique to the particular optical viewing device.

After placing the target per step 1210 and entering the associated data at step 1215, a user may "scope" the target in step 1220 such that the target is exactly demarcated by the distance between two distinguishable reticule markings. Importantly, as the distance between the two reticule markings will establish a ratio of linear distance to vertical target height for the specific optical viewing device, it is preferred that the target, when scoped in step 1220, exactly fill the space between the markings. If it does not, the user may adjust either the target size or the distance to target in step 1225. Upon adjusting the target size or distance, the data associated with such adjustments must be entered into the exemplary ballistic solutions device 100 in step 1215.

After establishing a target size and distance that causes the target to fill the space between two reticule markings in the optical viewing device, the user may designate and enter the number of "mils" M in step 1230 that will be represented by the distance between the markings. Importantly, for the exemplary optical viewing device, the distance between the markings will establish a user-defined ratio that is unique to the particular optical viewing device and, as such, one of ordinary skill will understand that a "mil" of demarcation for a scope having a user-defined ratio may not equate to the 27.7778 ratio that is generally understood in the art to be associated with an optical viewing device of a MILDOT type.

Using data RS and M, the exemplary ballistic solutions device 100 may calculate in routine 1235 a user-defined ratio for the particular optical viewing device. Referring back to the exemplary inputs of a 9-inch object placed at 50 yards, and assuming the object is designated to take up one user-defined MIL when viewed through the optical viewing device from 50 yards, a user-defined ratio may be calculated 1235 as 5.5556 (50/9=5.5556). After routine 1235, the process or method 1200 ends.

Advantageously, having established a user-defined ratio for the particular distance between reticule markings in the exemplary optical viewing device, one of ordinary skill in the art will understand that a user may "mil" distances to targets of known heights by applying the formula the formula described above wherein the ratio of target distance to target height is 5.55556 instead of 27.7778. Moreover, one of ordinary skill will understand that the user-defined MIL may also be used to apply ballistic solutions via "holdover" as is known in the art of long range shooting. Further, certain embodiments of a ballistic solutions device may be configured to render ballistic solutions based on the user-defined MIL ratio associated with a particular optical viewing device.

Systems, devices and methods for the provision of ballistic solutions have been described using detailed descriptions of embodiments thereof that are provided by way of example and are not intended to limit the scope of the disclosure. The described embodiments comprise different features, not all of which are required in all embodiments of a ballistic solutions device 100. Some embodiments of a ballistic solutions device 100 utilize only some of the features or possible combinations of the features. Moreover, some embodiments of a ballistic solutions device 100 may be configured to work in conjunction with multiple optical viewing devices, rifle/scope combinations, field applications, etc. and, as such, it will be understood that multiple instances of a ballistic solutions device 100, wherein each instance may utilize only some of the features or possible combinations of the features, may be reside within a single embodiment of a given ballistic solutions device 100. Variations of embodiments of a ballistic solutions device 100 that are described and embodiments of a ballistic solutions device 100 comprising different combinations of features noted in the described embodiments will occur to persons of the art.

It will be appreciated by persons skilled in the art that systems, devices and methods for the provision of ballistic solutions is not limited by what has been particularly shown and described herein above. Rather, the scope of systems, devices and methods for the provision of ballistic solutions is defined by the claims that follow.

What is claimed is:

1. A system for calculating a ballistic solution, the system comprising:

an optical viewing device; and a ballistic solutions device comprising a component operable for:

storing at least one of zero data and a prior ballistic solution in a memory device;

retrieving at least one of zero data and the prior ballistic solution from the memory device; and calculating the ballistic solution based on at least one of the zero data and the prior ballistic solution from the memory device.

2. The system of claim 1, wherein the zero data comprises information about a ballistics device fired at a range of a known distance that establishes one or more baseline offsets for the optical viewing device.

3. The system of claim 1, wherein the ballistic solutions device is coupled to the optical viewing device.

4. The system of claim 1, wherein the prior ballistic solution is based on the measured angle and a height of the target.

5. The system of claim 4, wherein the prior ballistic solution comprises a distance from the optical viewing device to the target.

6. The system of claim 5, wherein the ballistic solutions device is further configured to query Data Observed from Prior Engagements (DOPE) records based on the distance to target and the calculated ballistic solution is based on the results of the query.

7. The system of claim 6, wherein the ballistic solutions device is further configured to receive manual entry of user-defined data and further comprises one or more sensors configured to measure ambient field conditions; and the query of DOPE records is further based on one or more of the manually entered user-defined data and measured ambient field conditions.

8. The system of claim 7, wherein the ambient field conditions measured by the one or more sensors comprise at least one of barometric pressure, humidity, altitude and temperature.

9. The system of claim 7, wherein the prior ballistic solution comprises a mathematical manipulation of the queried DOPE records based on one or more of the manually entered user-defined data and measured ambient field conditions.

10. The system of claim 9, wherein the mathematical manipulation comprises at least one of extrapolation and interpolation of DOPE records.

11. The system of claim 1, wherein the prior ballistic solution is rendered in units selected from the units comprising MILS, minutes of angle (MOA), inches per hundred yards, radians and user-defined units.

12. The system of claim 1, further comprising a component operable to measure angular movement that includes at least one of an inclinometer, a gyroscope and an accelerometer.

13. A computer program product comprising a non-transitory computer usable medium having a computer readable program code embodied therein, said computer readable program code adapted to be executed to implement a method for calculating a ballistics solution, said method comprising:

receiving user-defined data;

calculating a distance to an identified target;

querying a Data Observed from Prior Engagements (DOPE) table based on the distance to the identified target;

calculating a ballistic solution based on the received user-defined data and the DOPE table;

rendering the calculated ballistic solution on a display component.

14. The computer program product of claim 13, wherein the querying of the DOPE table comprises selecting one or more of manually entered user-defined data and measured ambient field conditions.

15. The computer program product of claim 13, wherein calculating the ballistic solution comprises a mathematical manipulation of the queried DOPE records, wherein the mathematical manipulation comprises at least one of extrapolation and interpolation of DOPE records.

16. The computer program product of claim 13, further comprising:

receiving an angular measurement; and wherein calculating the ballistic solution comprises calculating the ballistic solution using the angular measurement in addition to the user-defined data and the DOPE table.

17. A computer program product comprising a non-transitory computer usable medium having a computer readable program code embodied therein, said computer readable program code adapted to be executed to implement a method for calculating a ballistics solution, said method comprising:

receiving user-defined data;

measuring cant of an optical viewing device;

calculating a ballistic solution based on the received user-defined data and cant; and rendering the calculated ballistic solution on a display component.

18. The computer program product of claim 17, further comprising:

receiving an angular measurement; and wherein calculating the ballistic solution comprises calculating the ballistic solution using the angular measurement in addition to the user-defined data and cant.

19. The computer program product of claim 17, wherein the ballistic solution is based on the measured angle and an estimated actual height of an identified target.

20. The computer program product of claim 17, further comprising:

receiving an angular measurement; and wherein calculating the ballistic solution comprises calculating the ballistic solution using the angular measurement in addition to the user-defined data and a Data Observed from Prior Engagements (DOPE) table.

* * * * *